US011391444B2

(12) United States Patent
Wang et al.

(10) Patent No.: US 11,391,444 B2
(45) Date of Patent: Jul. 19, 2022

(54) MOUNTING BASE OF LAMP, LIGHTING ASSEMBLY AND LAMP

(71) Applicant: OPPLE LIGHTING CO., LTD., Shanghai (CN)

(72) Inventors: Kai Wang, Shanghai (CN); Hu Zhang, Shanghai (CN); Zhanguo Liu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/139,969

(22) Filed: Dec. 31, 2020

(65) Prior Publication Data

US 2021/0123585 A1 Apr. 29, 2021

Related U.S. Application Data

(63) Continuation of application No. PCT/CN2019/107114, filed on Sep. 20, 2019.

(30) Foreign Application Priority Data

Sep. 20, 2018 (CN) ..... 201821542969.1
Sep. 20, 2018 (CN) ..... 201821542998.8
Sep. 20, 2018 (CN) ..... 201821543000.6

(51) Int. Cl.
*F21V 19/00* (2006.01)
*F21V 29/76* (2015.01)
(Continued)

(52) U.S. Cl.
CPC ..... *F21V 19/0005* (2013.01); *F21S 4/28* (2016.01); *F21V 3/00* (2013.01); *F21V 7/04* (2013.01);
(Continued)

(58) Field of Classification Search
CPC .... F21V 19/0005; F21V 19/04; F21V 29/763; F21V 23/06; F21V 3/00; F21V 7/04; F21S 4/28
See application file for complete search history.

(56) References Cited

U.S. PATENT DOCUMENTS 5,672,003 A * 9/1997 Shemitz ..... F21S 2/00 248/214
9,908,597 B1 * 3/2018 Benson ..... B63B 45/04
(Continued)

FOREIGN PATENT DOCUMENTS

CN 101828245 A * 9/2010 ..... H01J 5/62
CN 103557448 A 2/2014
(Continued)

OTHER PUBLICATIONS

International Search Report of PCT Application No. PCT/CN2019/107114 dated Nov. 28, 2019 with English translation, (6p).

*Primary Examiner* — Anabel Ton
(74) *Attorney, Agent, or Firm* — Arch & Lake LLP

(57) ABSTRACT

A mounting base of a lamp, a lighting assembly, and a lamp are provided. The mounting base is configured to be in detachable connection with a plurality of lighting assemblies, the mounting base includes at least one mounting portion and a plurality of first electrical terminals fixed on the mounting portion, and the plurality of first electrical terminals on each mounting portion are configured to be in plug-in fit with a plurality of second electrical terminals of the lighting assemblies in one-to-one correspondence. The plurality of first electrical terminals are configured to supply power to the plurality of lighting assemblies when plugged in with the plurality of second electrical terminals.

5 Claims, 15 Drawing Sheets

(51) Int. Cl.

| | |
|---|---|
| ***F21S 4/28*** | (2016.01) |
| ***F21V 7/04*** | (2006.01) |
| ***F21V 3/00*** | (2015.01) |
| ***F21V 19/04*** | (2006.01) |
| ***F21V 23/06*** | (2006.01) |
| ***H01R 13/518*** | (2006.01) |
| ***H01R 33/88*** | (2006.01) |
| ***H01R 33/965*** | (2006.01) |
| *F21Y 105/16* | (2016.01) |
| *H01R 33/94* | (2006.01) |

(52) U.S. Cl.

CPC ..... *F21V 19/04* (2013.01); *F21V 23/06* (2013.01); *F21V 29/763* (2015.01); *H01R 13/518* (2013.01); *H01R 33/88* (2013.01); *H01R 33/965* (2013.01); *F21Y 2105/16* (2016.08); *H01R 33/94* (2013.01)

(56) References Cited

U.S. PATENT DOCUMENTS

| | | | | |
|---|---|---|---|---|
| 10,813,201 | B1 * | 10/2020 | Ghahramani | F21V 23/0442 |
| 2007/0109806 | A1 | 5/2007 | Tsukamoto et al. | |
| 2008/0087911 | A1 * | 4/2008 | Stoyan | H05K 1/021 257/99 |
| 2010/0135007 | A1 * | 6/2010 | Seabrook | F21V 5/04 362/218 |
| 2010/0232155 | A1 * | 9/2010 | Wang | F21V 29/75 362/235 |
| 2014/0355254 | A1 * | 12/2014 | Grajcar | C12N 1/12 362/101 |
| 2017/0292664 | A1 * | 10/2017 | Pearson | F21V 29/70 |
| 2018/0135846 | A1 * | 5/2018 | Chen | F21V 5/007 |
| 2018/0187842 | A1 * | 7/2018 | Poon (Pan) | F21V 23/06 |
| 2019/0086047 | A1 * | 3/2019 | Jiang | F21V 29/56 |

FOREIGN PATENT DOCUMENTS

| | | | | | |
|---|---|---|---|---|---|
| CN | 106838729 | A | * | 6/2017 | |
| CN | 107816650 | A | | 3/2018 | |
| CN | 109185836 | A | | 1/2019 | |
| CN | 208652308 | U | | 3/2019 | |
| CN | 208652309 | U | | 3/2019 | |
| CN | 208652478 | U | | 3/2019 | |
| CN | 110285380 | A | * | 9/2019 | |
| JP | 2010212687 | A | * | 9/2010 | F21V 29/89 |
| KR | 101684567 | B1 | | 12/2016 | |
| WO | WO-2020057657 | A1 | * | 3/2020 | F21V 19/04 |
| WO | WO-2020209571 | A1 | * | 10/2020 | F21V 31/00 |

* cited by examiner

MOUNTING BASE OF LAMP, LIGHTING ASSEMBLY AND LAMP

CROSS-REFERENCE TO RELATED APPLICATIONS

This application is based upon and claims the priority of PCT patent application No. PCT/CN2019/107114 filed on Sep. 20, 2019 which claims priority to three Chinese patent applications No. 201821542998.8, No. 201821542969.1 and 201821543000.6, all filed on Sep. 20, 2018, the entire contents of all of which are hereby incorporated by reference for all purposes.

TECHNICAL FIELD

The present disclosure relates to the technical field of lighting devices, and in particular, relates to a mounting base of a lamp, a lighting assembly, and a lamp.

BACKGROUND

Lamps, as lighting devices, have been widely used in people's daily life and work. With continuous improvement of the quality of life, people put forward higher requirements for the structure, performance, appearance, and the like of lamps, which may bring enormous challenges for lamp design.

A traditional lamp is usually structured in the form of a single body, and the lighting intensity is relatively limited, which cannot satisfy user demand for lighting, especially the demand for lighting in large space.

SUMMARY

The present disclosure discloses a mounting base of a lamp, a lighting assembly, and a lamp.

In a first aspect of the present disclosure, a mounting base of a lamp is provided. The mounting base of the lamp includes: at least one mounting portion and a plurality of first electrical terminals fixed on the mounting portion, where the mounting base is configured to detachably connect with a plurality of lighting assemblies. The plurality of first electrical terminals on each mounting portion are configured to be in plug-in fit with a plurality of second electrical terminals of the plurality of lighting assemblies in one-to-one correspondence. The plurality of first electrical terminals are configured to supply power to the plurality of lighting assemblies when plugged in with the plurality of second electrical terminals.

In a second aspect of the present disclosure, a lamp is provided. The lamp includes: a mounting base and a lighting assembly, wherein a plurality of lighting assemblies are provided, each of the plurality of lighting assemblies is configured to be detachably mounted on the mounting base, the mounting base comprises a mounting portion, and a plurality of first electrical terminals and a top cover fixed on the mounting portion, the mounting portion is provided in a strip-shaped structure, and the top cover is disposed at top of the mounting portion; the lighting assembly comprises a base, a light-emitting device, and an optical device, the light-emitting device and the optical device are both mounted on the base, and the base is mounted on the mounting base; and the light-emitting device comprises a second electrical terminal, and the plurality of first electrical terminals are in plug-in fit with a plurality of second electrical terminals of the lighting assemblies in one-to-one correspondence. The plurality of first electrical terminals are configured to supply power to the plurality of lighting assemblies when plugged in with the plurality of second electrical terminals.

In a third aspect of the present disclosure, a lamp is provided. The lamp includes: a mounting base and a lighting assembly, wherein a plurality of lighting assemblies are provided, each of the plurality of lighting assemblies is mounted on the mounting base and electrically connected to the mounting base, the mounting base comprises at least two mounting portions and a mounting bracket, the mounting portions are spaced apart from each other at a preset interval, and the mounting bracket connects at least two mounting portions; and the lighting assembly comprises a base, a light-emitting device, and an optical device, the light-emitting device and the optical device are both mounted on the base, and the base is mounted on the mounting base.

BRIEF DESCRIPTION OF THE DRAWINGS

The accompanying drawings described herein are used to provide a further understanding of the present disclosure and form a part of the present disclosure. The schematic examples and descriptions of the present disclosure are used to explain the present disclosure and do not constitute an improper limitation on the present disclosure. In the drawings.

DETAILED DESCRIPTION

Figure 1:
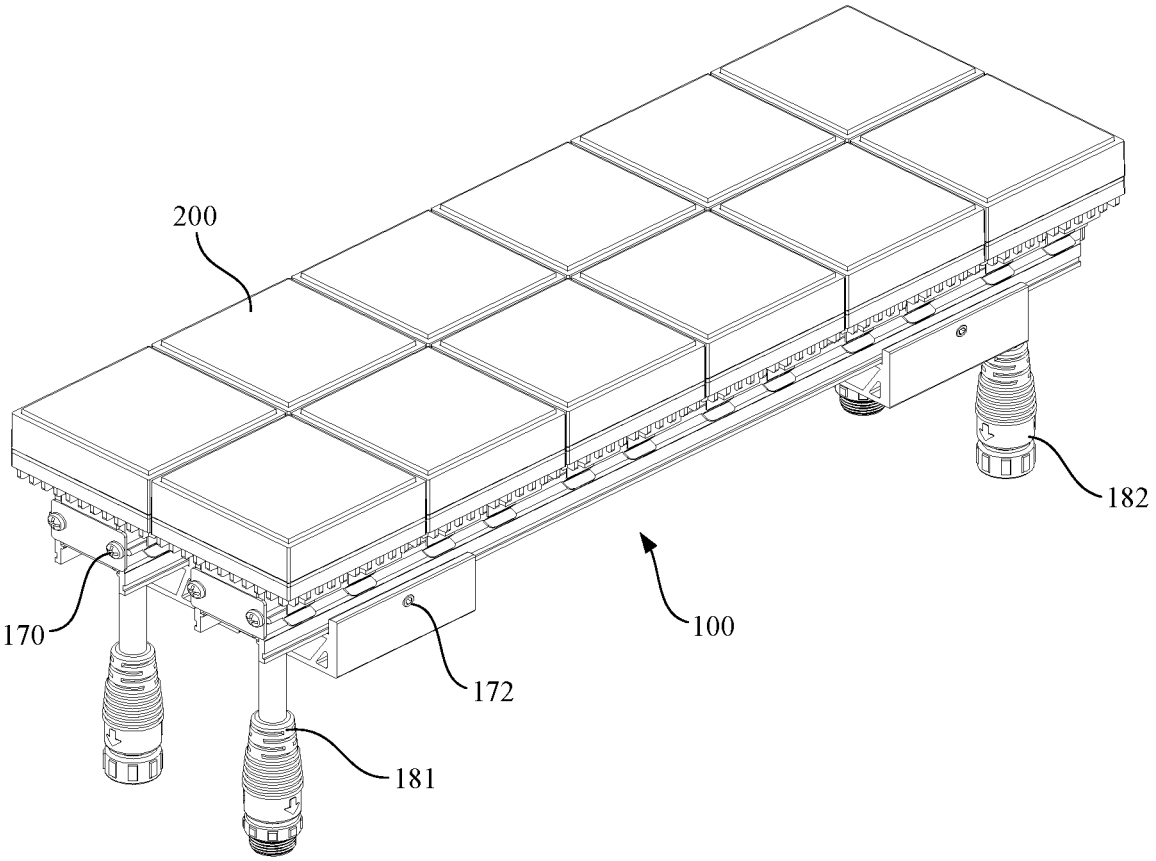
FIG. 1 is a schematic structural diagram of a lamp provided by an example of the present disclosure.

In order to make objectives, technical details of the examples of the present disclosure apparent, the technical solutions of the examples of the present disclosure will be described in a clearly and fully understandable way in connection with the specific examples and related drawings of the present disclosure. Apparently, the described examples are just part but not all of the examples of the present disclosure. Based on the described examples of the present disclosure herein, those skilled in the art can obtain other example(s), without any inventive work, which should be within the scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

DESCRIPTION OF REFERENCE NUMERALS IN THE DRAWINGS

100—mounting base; 110—mounting portion; 111—snap-fit protrusion; 112—mounting hole; 113—limiting groove; 114—top cover mounting portion; 114*a*—fastening hole; 115—matching protrusion; 116—glue identification portion; 120—top cover; 121—top plate; 122—bottom plate; 122*a*—notch, 123—bending plate; 130—bottom cover; 131—cover body; 132—matching protrusion; 140—mounting bracket; 141—main body plate; 141*a*—wire passing hole; 142—mounting plate; 142*a*—first bracket mounting hole; 142*b*—second bracket mounting hole; 143—mounting groove; 144—separation groove; 150—first electrical terminal; 151—main body; 152—clamping portion; 153—second sealing component accommodation groove; 154—annular flange; 161—terminal sealing component; 162—mounting portion sealing component; 171—first fastening component; 172—second fastening component; 181—inlet wire; 182—outlet wire; 190—circuit board;

200—lighting assembly; 210—base; 211—base body; 212—first elastic sheet; 213—second elastic sheet; 214—connecting portion; 214*a*—first connecting plate; 214*b*—second connecting plate; 215—snap-fit portion; 216—first snap-fit protrusion; 217—annular locating groove; 218—radiating fin; 219—annular protrusion; 219*a*—terminal accommodation hole; 220—light-emitting device; 221—light source plate; 222—light-emitting unit; 223—second electrical terminal; 230—optical device; 231—reflector; 232—diffusion casing; 232*a*—top; 232*aa*—first sealing component accommodation groove; 232*b*—second snap-fit protrusion; 232*c*—snap-fit depression; 232*d*—locating flange; 233—light transmitting glass; 234—diffusion casing sealing component; 240—surface cover; 241—opening; 242—third snap-fit protrusion; and 260—third fastening component.

The technical solutions disclosed by the respective examples of the present disclosure are described in detail below in conjunction with the accompanying drawings.

As illustrated in FIG. 1, an example of the present disclosure discloses a lamp, and the lamp can be used as a wall-wash lamp, a strip lamp, etc. The lamp includes a mounting base 100 and a lighting assembly 200. The lamp may have a plurality of light assemblies 200 which are detachably mounted on the mounting base 100 and arranged in an array. Moreover, when the lighting assembly 200 is mounted on the mounting base 100, the lighting assembly 200 and the mounting base 100 are electrically connected. The mounting base 100 may include at least one mounting portion 110. The lighting assembly 200 is specifically mounted on the mounting portion 110. Further, at least two mounting portions 110 are provided and spaced apart from each other at a preset interval, so as to allow more lighting assemblies 200 to be mounted. The preset interval may be flexibly determined depending on factors such as practical installation space. The mounting portion 110 may have a plate-like structure, and certainly may have any other suitable structure as long as the installation of the lighting assembly 200 can be achieved.

As illustrated in FIG. 8 to FIG. 12, in addition to the mounting portion 110, the mounting base 100 further includes a plurality of first electrical terminals 150 fixed on the mounting portion 110. As illustrated in FIG. 2 to FIG. 7, the lighting assembly 200 described above may specifically include a base 210, a light-emitting device 220, and an optical device 230. The light-emitting device 220 and the optical device 230 are both mounted on the base 210. The base 210 is detachably mounted on the mounting base 100. After power on, the light-emitting device 220 can emit light, and the optical device 230 can change parameters such as the direction and intensity of the light emitted by the light-emitting device 220 based on the principles of reflection, refraction, etc. of light, which may provide satisfactory luminous effect of the entire lamp against the user demand. The light-emitting device 220 may include a second electrical terminal 223. The plurality of first electrical terminals 150 on each mounting portion 110 are in plug-in fit with second electrical terminals 223 of a plurality of lighting assemblies 200 in one-to-one correspondence, so as to supply power to the lighting assemblies 200.

In the lamp provided by the examples of the present disclosure, the plurality of lighting assemblies 200 are provided, and the mounting base 100 may be in detachable connection with the plurality of lighting assemblies 200. Thus, the effect of enhancing the luminous intensity of the lamp can be achieved by increasing the number of the lighting assemblies 200, thereby satisfying the user demand on lighting, especially the user demand on lighting in a large space. Moreover, the mounting base 100 is in detachable connection with each lighting assembly 200 and supplies power to the lighting assembly 200 by means of plug-in connection between the first electrical terminal 150 and the second electrical terminal 223. As such, different lighting assemblies 200 can be flexibly selected and combined in accordance with different lighting requirements, so as to better meet the user demand on lighting. In addition, the plug-in connection between the first electrical terminal 150 and the second electrical terminal 223 may contribute to positioning to a certain extent, so that the mounting base 100 and the lighting assembly 200 of the lamp can be installed more rapidly.

In this example of the present disclosure, the mounting portion 110 may be provided in a strip-shaped structure. The plurality of first electrical terminals 150 are sequentially mounted in the extending direction of the mounting portion 110, so as to allow the plurality of lighting assemblies 200 to be mounted. With the strip-shaped structure, the extending direction of the mounting portion 110 is identical to the length direction of the mounting portion 110. The mounting portion 110 may have a plurality of positions for mounting the lighting assemblies 200, and these positions may be distributed uniformly, so that the plurality of lighting assemblies 200 can be uniformly mounted on the mounting portion 110. As such, the plurality of lighting assemblies 200 mounted on the same mounting portion 110 may have an identical installation height, thus enhancing the luminous effect of the lamp on one hand and providing more aesthetically pleasing appearance on the other hand. In addition, with such a structure, the length of the mounting portion 110 may be chosen flexibly in accordance with actual user demand, so as to allow different number of lighting assemblies 200 to be mounted, and therefore, the lamp has better scalability.

The mounting portion 110 and the lighting assembly 200 may be installed together by means of bolted-on connection, riveting, clamped connection, etc. To guarantee the installation reliability of the lighting assembly 200 on the mounting portion 110 and further to facilitate the mounting manipulation, clamped connection is preferred between the lighting assembly 200 and the mounting portion 110 in this example of the present disclosure.

Further, the structure for realizing the clamped connection between the lighting assembly 200 and the mounting portion 110 may be in numerous forms. For example, a snap-fit column may be provided on the lighting assembly 200, while a snap-fit hole is provided in the mounting portion 110, and the clamped connection between the lighting assembly 200 and the mounting portion 110 can be achieved by means of fitting between the snap-fit column and the snap-fit hole. In this example of the present disclosure, as illustrated in FIG. 8 to FIG. 12, snap-fit protrusions 111 are provided on two opposite outer sides of the mounting portion 110, and the lighting assembly 200 is clamped on the snap-fit protrusions 111. Compared with holes, the snap-fit protrusions 111 provided on the side surfaces of the mounting portion 110 may lead to enhanced structural strength of the mounting portion 110, so that the mounting portion 110 is not prone to deformation and thus would not have adverse influence on the appearance, luminous effect, etc. of the lamp.

Alternatively, a plurality of snap-fit protrusions 111 may be provided on the side surface of the mounting portion 110, the snap-fit protrusions 111 are arranged in the extending direction of the mounting portion 110, and each lighting assembly 200 is in snap fit with the corresponding snap-fit protrusion 111. Certainly, the snap-fit protrusion 111 may be provided in a strip-shaped structure as well. That is, the snap-fit protrusion 111 extends in the extending direction of the mounting portion 110, and the plurality of lighting assemblies 200 mounted on the same mounting portion 110 are all in snap fit with the same snap-fit protrusion 111. Since the snap-fit protrusions 111 of a single mounting portion 110 are at the same height throughout, the plurality of lighting assemblies 200 mounted on the mounting portion 110 can be retained at the identical height more reliably, thereby improving the appearance and the luminous effect of the lamp.

The base 210 of the lighting assembly 200 may include a base body 211, and a first elastic sheet 212 and a second elastic sheet 213 that are mounted on the base body 211. The light-emitting device 220 and the optical device 230 are both mounted on the base body 211. The first elastic sheet 212 and the second elastic sheet 213 are arranged opposite and clamped on the snap-fit protrusions 111 on two opposite outer sides of the mounting portion 110, respectively. The first elastic sheet 212 and the second elastic sheet 213 both have a certain degree of elasticity and may undergo elastic deformation when being acted upon by an external force, thus giving rise to a trend of deformation recovery in which an acting force on the mounting portion 110 may be caused.

Specifically, when the lighting assembly 200 is assembled, the first elastic sheet 212 and the second elastic sheet 213 are first brought into contact with the mounting portion 110, and then an external force is applied on the lighting assembly 200, which causes the first elastic sheet 212 and the second elastic sheet 213 to deform under the force and thus slide relative to the mounting portion 110 until the first elastic sheet 212 and the second elastic sheet 213 are clamped with the snap-fit protrusions 111. In this case, an interaction force may be caused between the mounting portion 110 and each of the first elastic sheet 212 and the second elastic sheet 213, thereby preventing the lighting assembly 200 from being disengaged from the mounting portion 110. Such a clamped connection structure is relatively simple, and the assembling manipulation of the lighting assembly 200 and the mounting portion 110 can be simplified.

Figure 7:
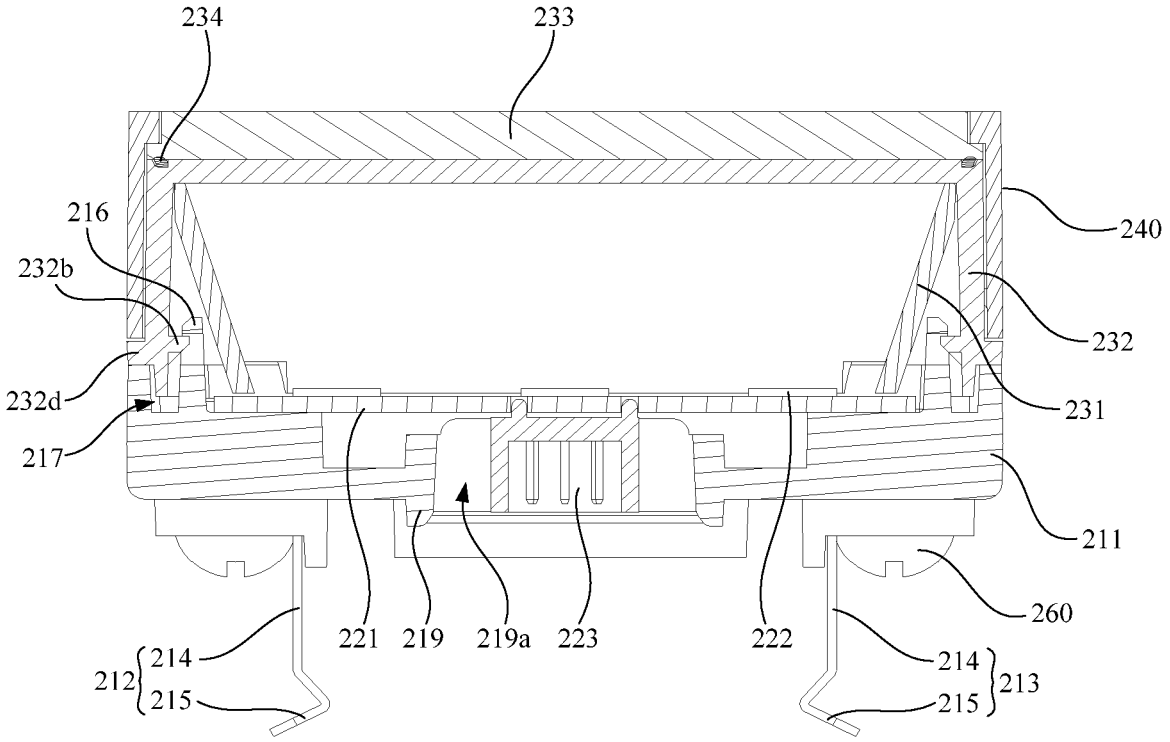
FIG. 7 is a cross-sectional view of a structure illustrated in FIG. 6.
Figure 8:
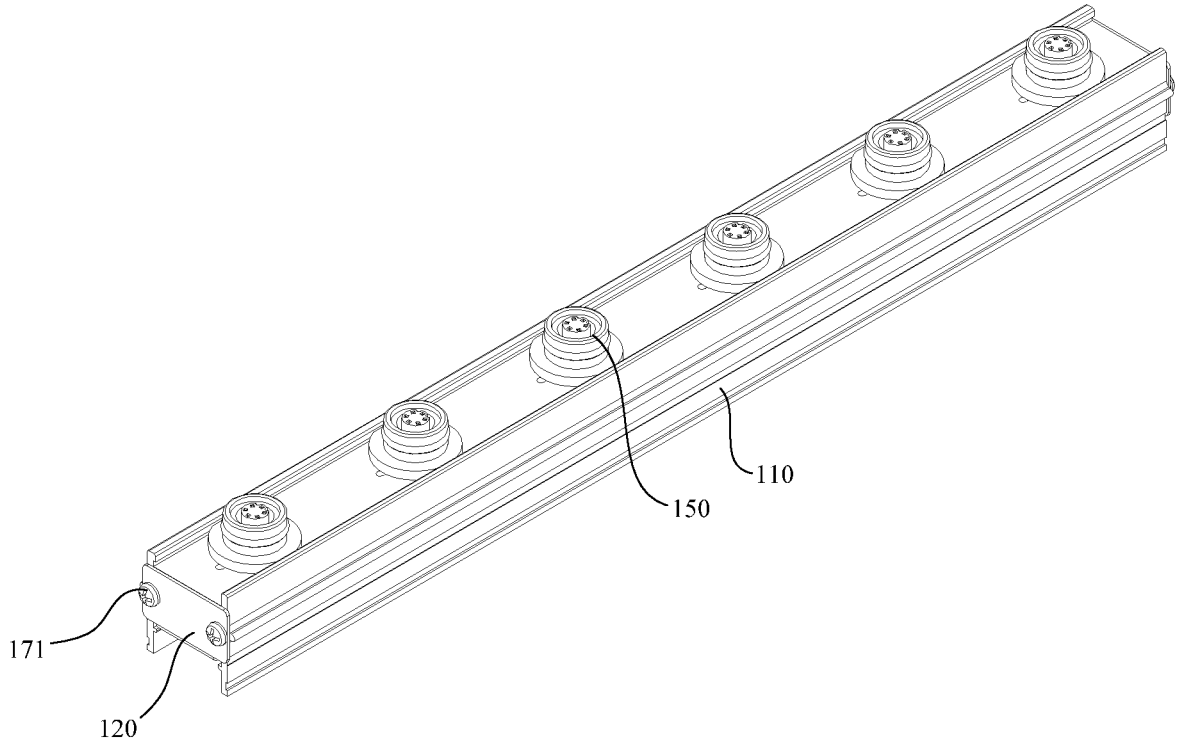
FIG. 8 is a schematic diagram of a partial structure of a lamp provided by an example of the present disclosure.
Figure 9:
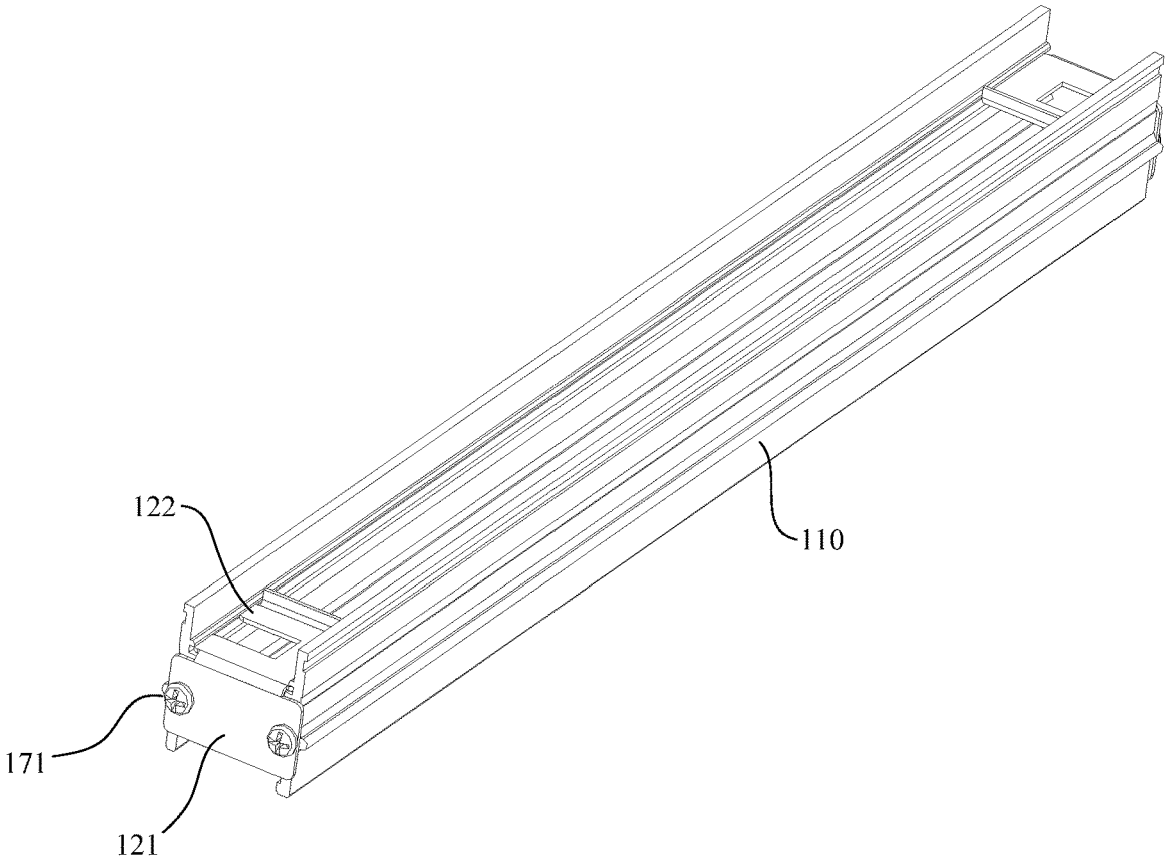
FIG. 9 is a schematic structural diagram of a structure illustrated in FIG. 8 from another perspective.
Figure 10:
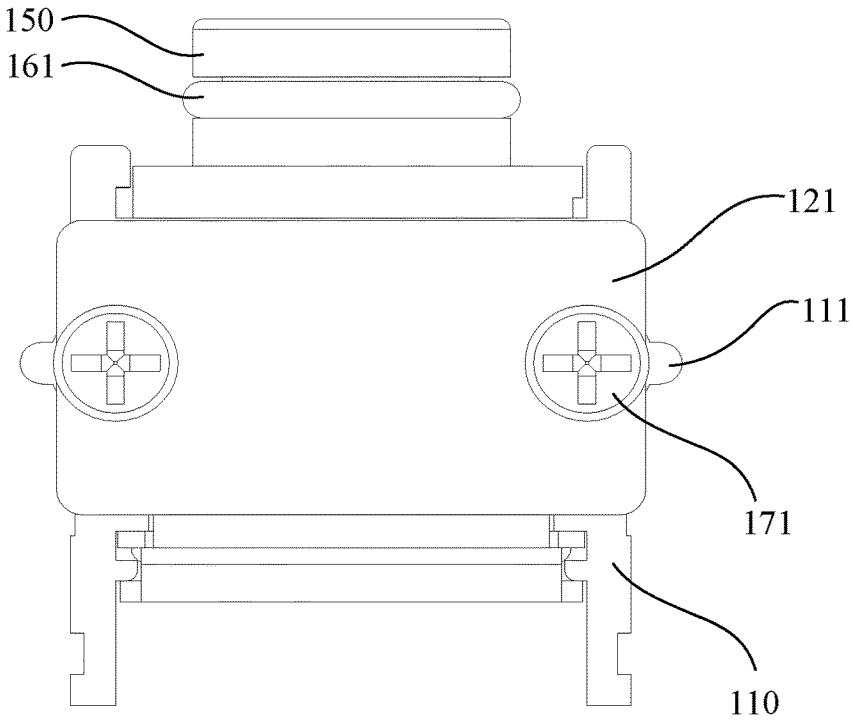
FIG. 10 is a front view of the structure illustrated in FIG. 8.

As illustrated in FIG. 7, in an alternative example, each of the first elastic sheet 212 and the second elastic sheet 213 includes a connecting portion 214 and a snap-fit portion 215. The snap-fit portion 215 is connected to the base body 211 by means of the connecting portion 214 and is clamped with the snap-fit protrusion 111. The snap-fit portion 215 of the first elastic sheet 212 and the snap-fit portion 215 of the second elastic sheet 213 are bent towards each other. That is, the snap-fit portion 215 of the first elastic sheet 212 is bent towards the direction close to the second elastic sheet 213, and the snap-fit portion 215 of the second elastic sheet 213 is bent towards the direction close to the first elastic sheet 212. With the bent structure as described herein, the snap-fit portion 215 of the first elastic sheet 212 and the snap-fit portion 215 of the second elastic sheet 213 both have a protruding structure, and the protruding structure can be in better snap fit with the snap-fit protrusions 111, thus improving the reliability of the clamped connection.

In a specific example, for a single lighting assembly 200, only one of the first elastic sheet 212 and the second elastic sheet 213 is provided. However, considering that such a structure design may easily lead to inadequate strength of connection between the lighting assembly 200 and the mounting portion 110, a plurality of first elastic sheets 212 or a plurality of second elastic sheets 213 may be arranged in the extending direction of the mounting portion 110 in a single lighting assembly 200, or a plurality of first elastic sheets 212 and a plurality of second elastic sheets 213 may be arranged in the extending direction of the mounting portion 110 in a single lighting assembly 200. With increasing number of the first elastic sheets 212 and the second elastic sheets 213, the connection points between the lighting assembly 200 and the mounting portion 110 may increase, thereby providing enhanced connection strength between the lighting assembly 200 and the mounting portion 110.

Figure 4:
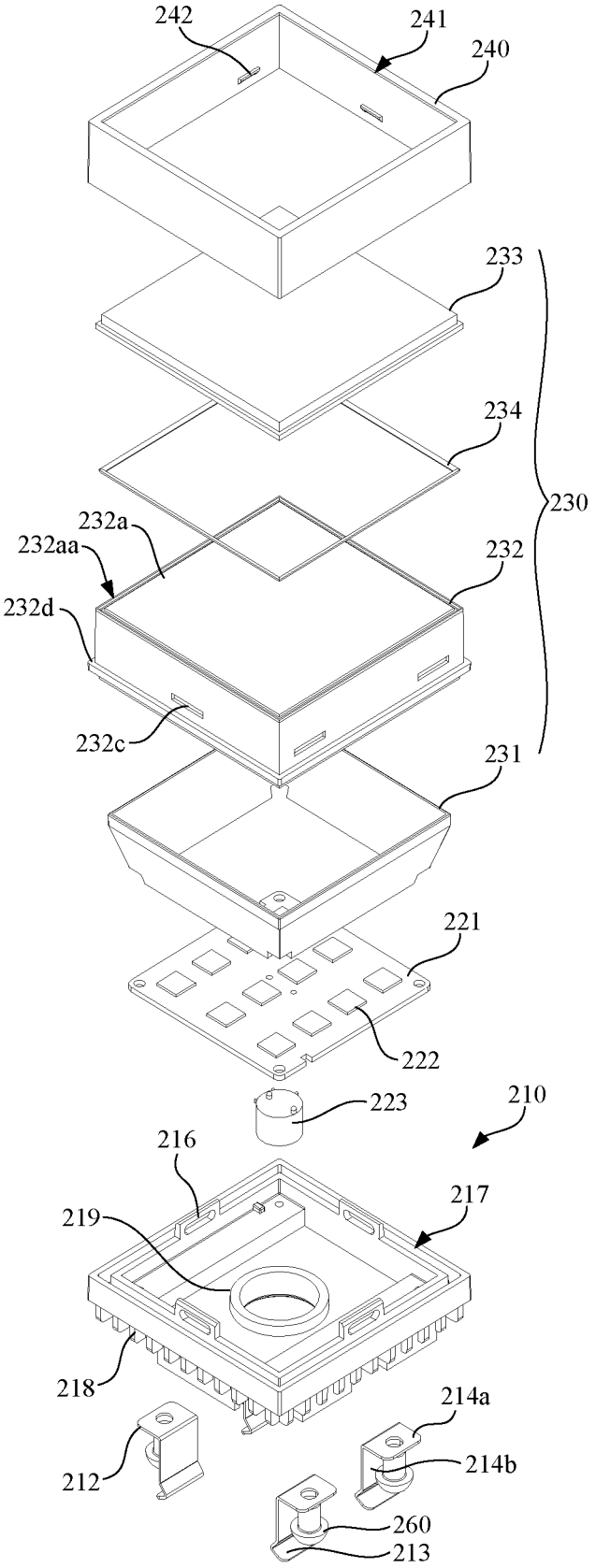
FIG. 4 is an exploded view of a lighting assembly in a lamp provided by an example of the present disclosure.
Figure 5:
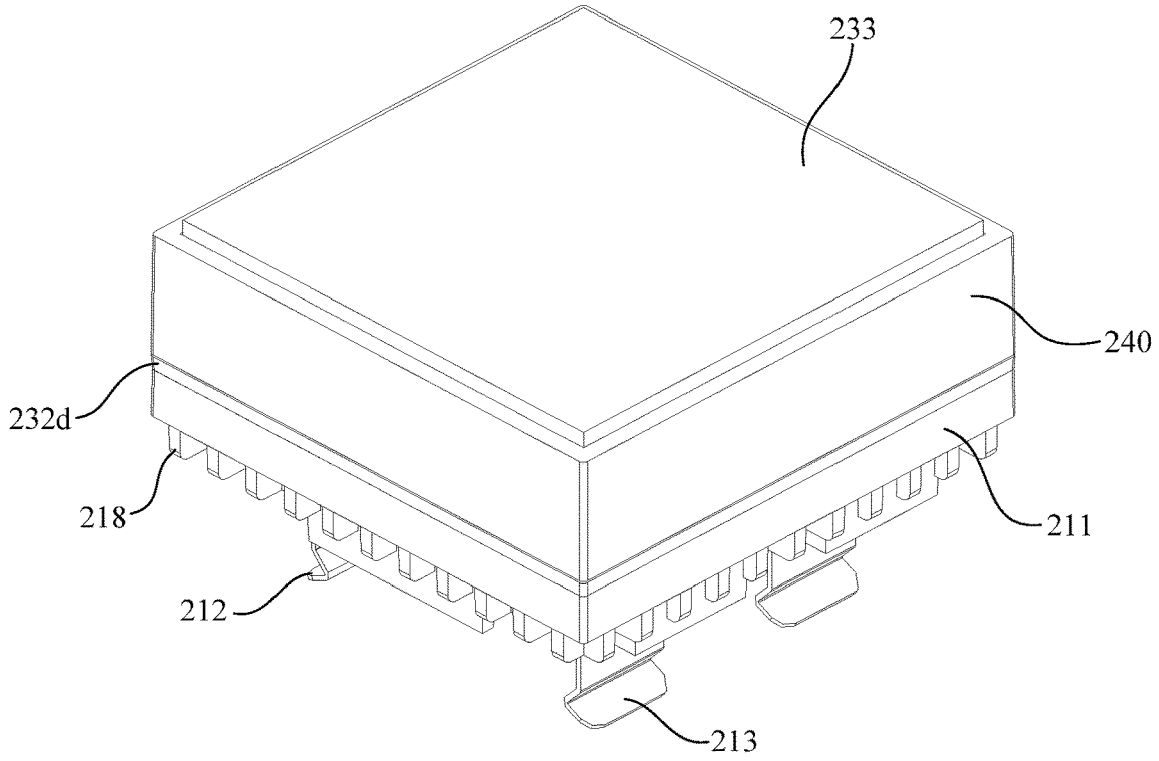
FIG. 5 is a schematic structural diagram of a lighting assembly in a lamp provided by an example of the present disclosure.
Figure 6:
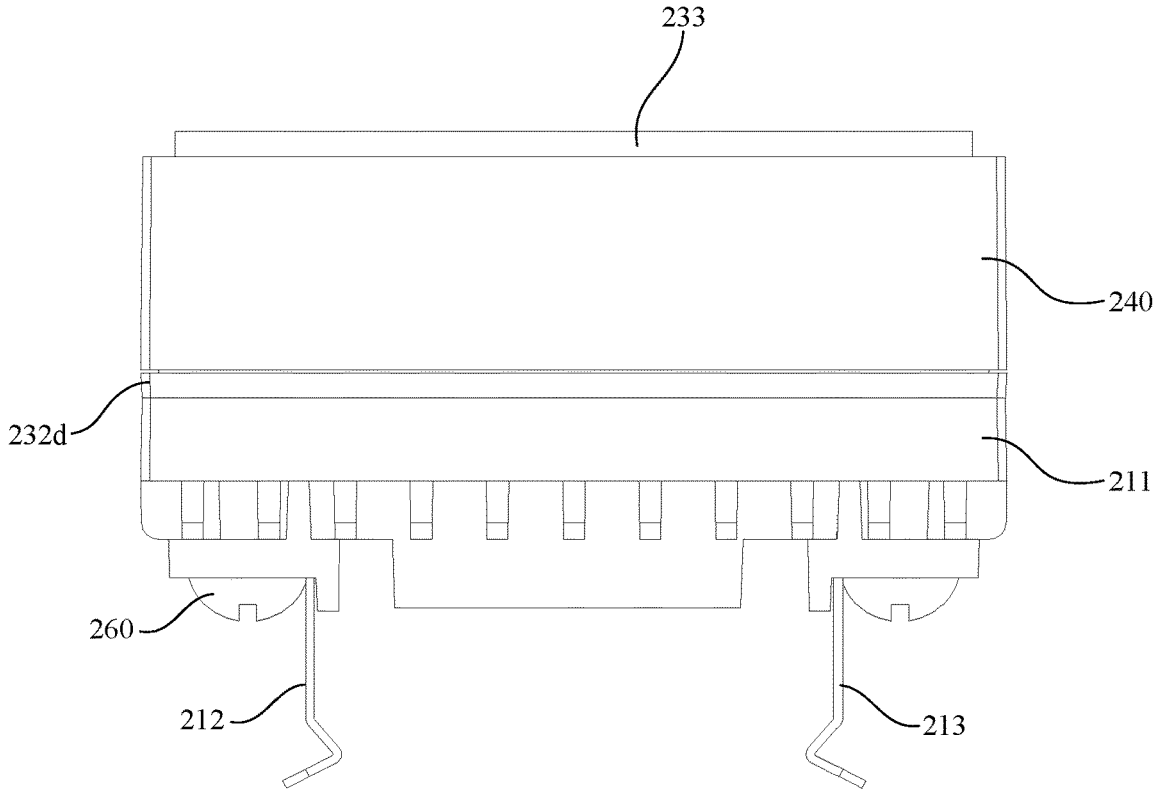
FIG. 6 is a front view of a structure illustrated in FIG. 5.

As illustrated in FIG. 4, the connecting portion 214 may specifically include a first connecting plate **214*a* and a second connecting plate 214*b*. The first connecting plate 214*a* and the second connecting plate 214*b* are connected into an L-shaped structure. The first connecting plate 214*a* fits and is in fixed connection with the base body 211, the first connecting plate 214*a* and the base body 211 may specifically be fixedly connected by a third fastening component 260, and the third fastening component 260 may be a screw. The second connecting plate 214***b* is connected to the snap-fit portion 215. Due to a large contact area between the first connecting plate 214*a* and the base body 211, fixed connection of the first connecting plate 214*a* and the base body 211 may result in high connection strength, which may allow the lighting assembly 200 to have higher structural strength.

As illustrated in FIG. 4 and FIG. 7, in this example of the present disclosure, the lighting assembly 200 may further include a surface cover 240. The optical device 230 specifically includes a reflector 231 and a diffusion casing 232 housing the reflector 231. The reflector 231 is disposed on a light-emitting side of the light-emitting device 220, and thus light emitted by the light-emitting device 220 is reflected by the reflector 231, so that the light can be concentrated to shine out, thereby improving the utilization of the light. The diffusion casing 232 is in fixed connection with the base 210 and has a top 232*a* arranged opposite to the light-emitting device 220. That is, the diffusion casing 232 has a semi-enclosed structure and may be fixed to the base 210 to form an enclosed cavity. At least a part of the light-emitting device 220 and the reflector 231 are located in the enclosed cavity. The light emitted by the light-emitting device 220 may shine on the diffusion casing 232 after being reflected by the reflector 231. The diffusion casing 232 may further adjust the direction of the light, which may allow the light to shine out more uniformly through the diffusion casing 232. The surface cover 240 is fastened around the diffusion casing 232 and mainly serves as an exterior component of the lighting assembly 200, so as to protect the components such as the diffusion casing 232, the reflector 231, and the light-emitting device 220 and meet the user demand on the appearance of the lamp.

In a further example, the optical device 230 may further include a light transmitting glass 233. The surface cover 240 has an opening 241 at the top. The light transmitting glass 233 is disposed at the opening 241 and covers the top 232*a* of the diffusion casing 232. In this case, the surface cover 240 and the light transmitting glass 233 may both serve as exterior components of the lighting assembly 200. The surface cover 240 mainly serves to protect the components, the light transmitting glass 233 may provide more aesthetically pleasing appearance, and therefore, such a structure may meet the requirements for both of the structural strength and appearance of the lamp.

It should be noted that, the light transmitting glass 233 may be optical glass or treated glass, such as sand-blasted glass and silk-screen glass. In particular, the structural form of the light transmitting glass 233 may be flexibly chosen in accordance with different user requirements, and the examples of the present disclosure are not limited in this aspect.

In actual use, a lamp may be used in an environment with high humidity or an environment with the possibility of exposure to water, and therefore, the water-proof performance of the lamp becomes one of key factors determining the service life of the lamp. For example, the lamp is used outdoors, and in this case, the lamp is specifically an outdoor lamp. On this basis, the optical device 230 may further include a diffusion casing sealing component 234, and the diffusion casing sealing component 234 is hermetically disposed between the top 232*a* of the diffusion casing 232 and the light transmitting glass 233. The diffusion casing sealing component 234 may be a sealing ring having a circular cross section, a semicircular cross section, or a cross section in any other suitable shape, which can prevent the liquid such as water from entering the lighting assembly 200 through the gap between the diffusion casing 232 and the light transmitting glass 233, thus achieving the purpose of improving the water-proof performance of the lamp.

For the convenience of mounting of the diffusion casing sealing component 234, a first sealing component accommodation groove 232*aa* may be provided at the top 232*a* of the diffusion casing 232. The diffusion casing sealing component 234 is located in the first sealing component accommodation groove 232*aa*. The first sealing component accommodation groove 232*aa* may be an annular groove, which may be provided at the edge of the top 232*a* to obtain a large space size, thereby facilitating being provided with a larger diffusion casing sealing component 234 and better sealing effect between the diffusion casing 232 and the light transmitting glass 233. When the lamp is assembled, the diffusion casing sealing component 234 is placed in the first sealing component accommodation groove 232*aa*, and then the diffusion casing 232 and the light transmitting glass 233 are installed together, so that the diffusion casing sealing component 234 is pressed to be in good fit with the diffusion casing 232 and the light transmitting glass 233.

Referring to FIG. 7, for the convenience of mounting, a first snap-fit protrusion 216 protruding towards the diffusion casing 232 may be provided on the base 210, a second snap-fit protrusion 232*b* may be provided on an inner surface of the diffusion casing 232, and the first snap-fit protrusion 216 is in snap fit with the second snap-fit protrusion 232*b*. Specifically, the first snap-fit protrusion 216 may be provided with a groove or a through hole. The second snap-fit protrusion 232*b* is in snap fit with the groove or the through hole. There may be a plurality of first snap-fit protrusions 216 that are arranged along the edge of the base 210. Correspondingly, there may be a plurality of second snap-fit protrusions 232*b* that are arranged in the circumferential direction of the diffusion casing 232. The plurality of first snap-fit protrusions 216 are clamped with the second snap-fit protrusions 232*b* in one-to-one correspondence, thereby improving the installation reliability between the base 210 and the diffusion casing 232.

Similarly, a third snap-fit protrusion is provided on one of an outer surface of the diffusion casing 232 and an inner surface of the surface cover 240, while a snap-fit depression is provided on the other of the outer surface of the diffusion casing 232 and the inner surface of the surface cover 240, and the third snap-fit protrusion is in snap fit with the snap-fit depression. There may be a plurality of snap-fit protrusions and a plurality of snap-fit depressions, so as to improve the snap-fit effect. As illustrated in FIG. 4 and FIG. 7, in a specific example, the snap-fit depression 232*c* may be provided on the outer surface of the diffusion casing 232, while the third snap-fit protrusion 242 may be provided on the inner surface of the surface cover 240. Each of the outer surface of the diffusion casing 232 and the inner surface of the surface cover 240 may include a plurality of lateral surfaces sequentially connected to each other. One or more snap-fit depressions 232*c* may be provided on each lateral surface of the diffusion casing 232, and one or more third snap-fit protrusions 242 may be provided on each lateral surface of the surface cover 240. To guarantee the reliability of the clamped connection and control the manufacturing cost of the lamp, a plurality of snap-fit depressions 232*c* may be provided on a part of the lateral surfaces of the diffusion casing 232.

For the convenience of assembling the base 210 and the diffusion casing 232, an annular locating groove 217 may be provided on the base 210. The bottom edge of the diffusion casing 232 is located in the annular locating groove 217, a locating flange 232*d* is provided on the outer surface of the diffusion casing 232, and the locating flange 232*d* is in locating fit with the top edge of the base 210. In specific manipulation, since the annular locating groove 217 is easily visible, the bottom edge of the diffusion casing 232 can be aligned to the annular locating groove 217 and located in the annular locating groove 217, and then the diffusion casing 232 is continuously moved, so that the locating flange 232*d* of the diffusion casing 232 is in location fit with the top edge of the base 210, thereby realizing pre-locating of the base 210 and the diffusion casing 232. Then, the base 210 and the diffusion casing 232 are in precise snap fit. Certainly, such a structure may also assist in limiting the relative positions of the base 210 and the diffusion casing 232, thus sharing the acting forces on the respective snap-fit structures and prolonging the service life of the snap-fit structures.

In this example of the present disclosure, a plurality of radiating fins 218 spaced apart from each other may be disposed on the outer surface of the base 210. These radiating fins 218 may assist in dissipating the heat generated during the operation of the lamp. Certainly, these radiating fins 218 may also further optimize the appearance of the lamp.

It should be noted that when the base 210 includes the base body 211, the first snap-fit protrusion 216, the annular locating groove 217 and the radiating fin 218 may be all provided on the base body 211.

The lighting assembly 200 provided by this example of the present disclosure may have an overall irregular or regular structure. In case of the regular structure, the lamp can be manufactured more conveniently. For example, the lighting assembly 200 may have a triangular structure, a square structure, a diamond-shaped structure, a circular structure, an oval-shaped structure, or the like, that is, when viewed from the top or the bottom, the lamp is triangular, square, diamond-shaped, circular, oval-shaped, etc. Relatively speaking, when the lighting assembly 200 is provided in a triangular structure, a square structure, or a diamond-shaped structure, the gap between the adjacent lighting assemblies 200 can be reduced as much as possible by optimizing the arrangement of the plurality of lighting assemblies 200, thus improving the space utilization of the entire lamp.

The light-emitting device 220 is one of core devices for realizing the light-emitting function in the lamp. As illustrated in FIG. 4 and FIG. 7, in this example of the present disclosure, in addition to the second electrical terminal 223, the light-emitting device 220 may further include a light source plate 221 and a plurality of light-emitting units 222 disposed on the light source plate 221. The second electrical terminal 223 is mounted on the light source plate 221 and electrically connected to the plurality of light-emitting units 222. The energy that the light-emitting device 220 needs may be provided from the first electrical terminal 150 to reach each light-emitting unit 222 sequentially through the second electrical terminal 223 and the light source plate 221, so as to enable each light-emitting unit 222 to emit light. Such a light-emitting device 220 has the advantage of compact structure, and when the lighting assembly 200 is mounted on the mounting base 100, the second electrical terminal 223 and the first electrical terminal 150 are plugged into each other, so as to realize assembling and electrical connection between the second electrical terminal 223 and the first electrical terminal 150, thereby providing convenient manipulation and high assembling efficiency.

Figure 11:
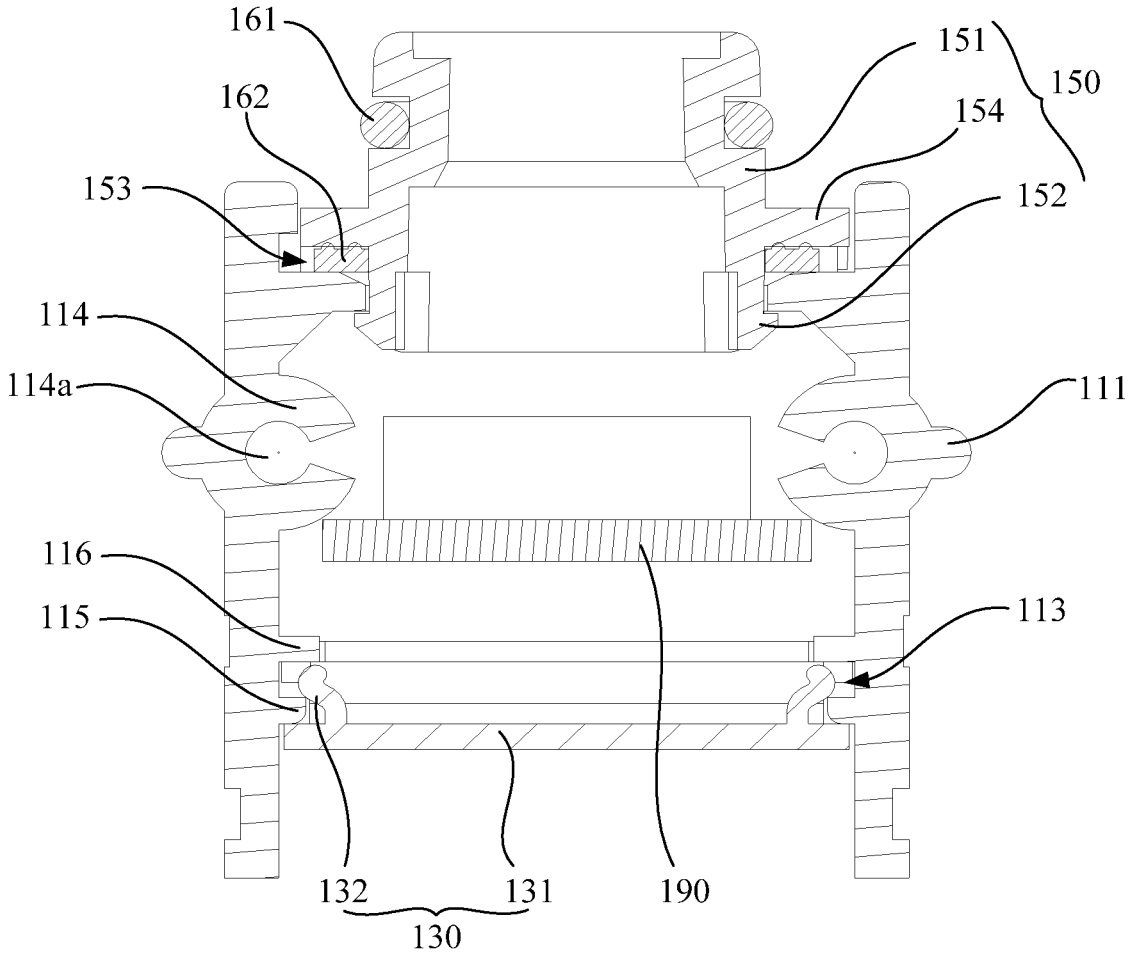
FIG. 11 is a cross-sectional view of a structure illustrated in FIG. 10.
Figure 12:
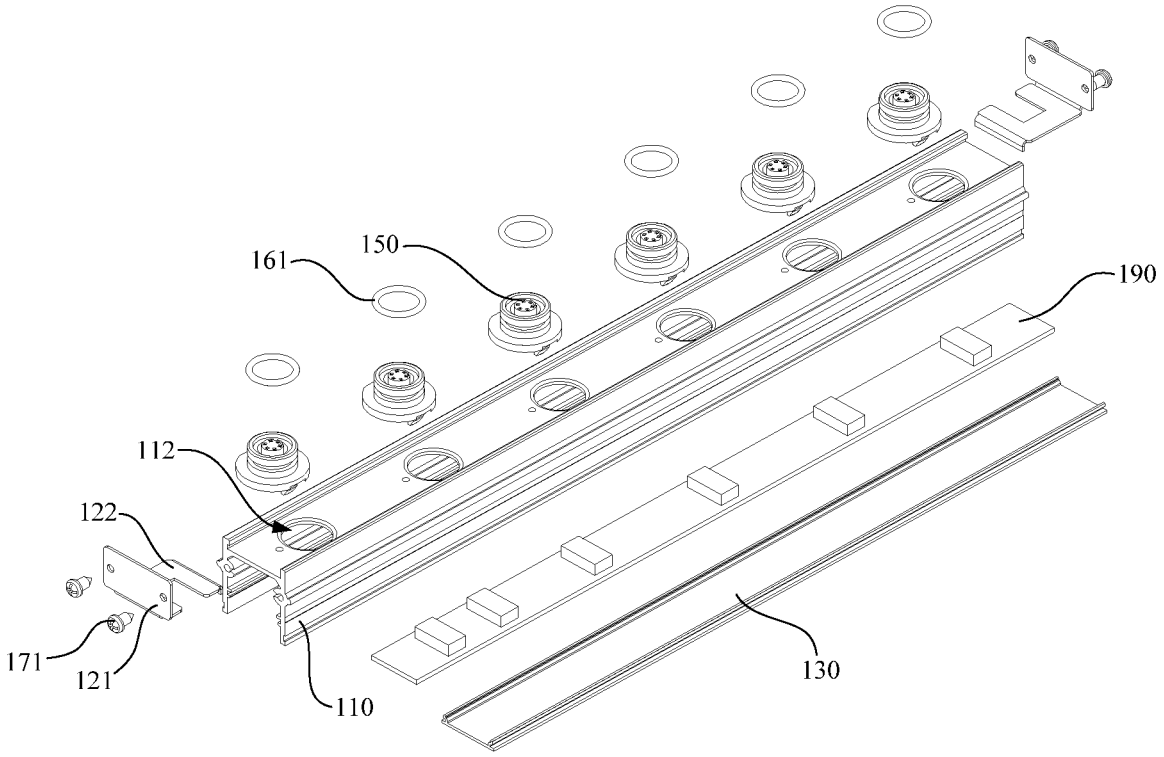
FIG. 12 is an exploded view of the structure illustrated in FIG. 8.
Figure 13:
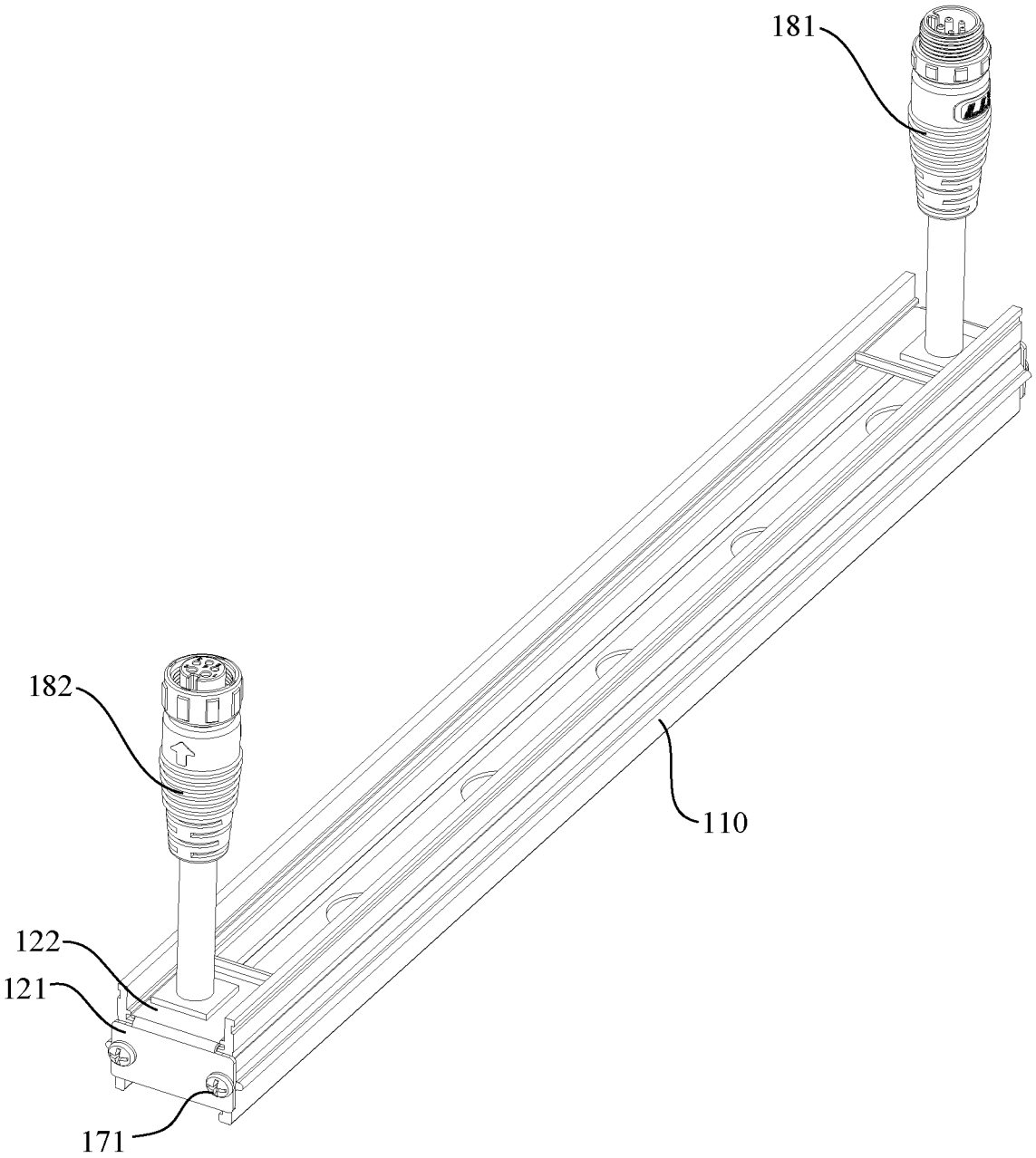
FIG. 13 is a schematic diagram of another partial structure of a lamp provided by an example of the present disclosure.
Figure 14:
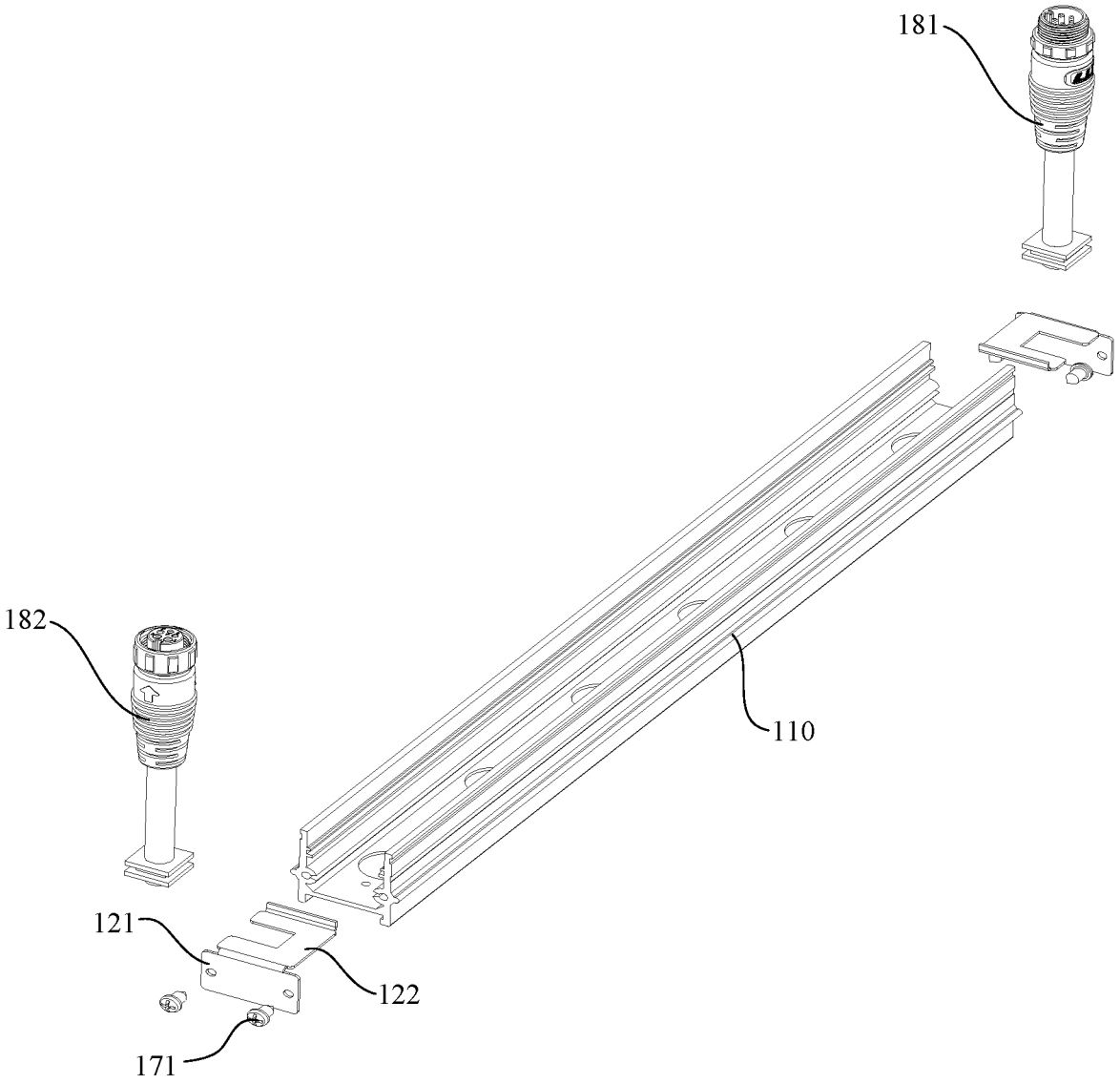
FIG. 14 is an exploded view of a structure illustrated in FIG. 13.
Figure 15:
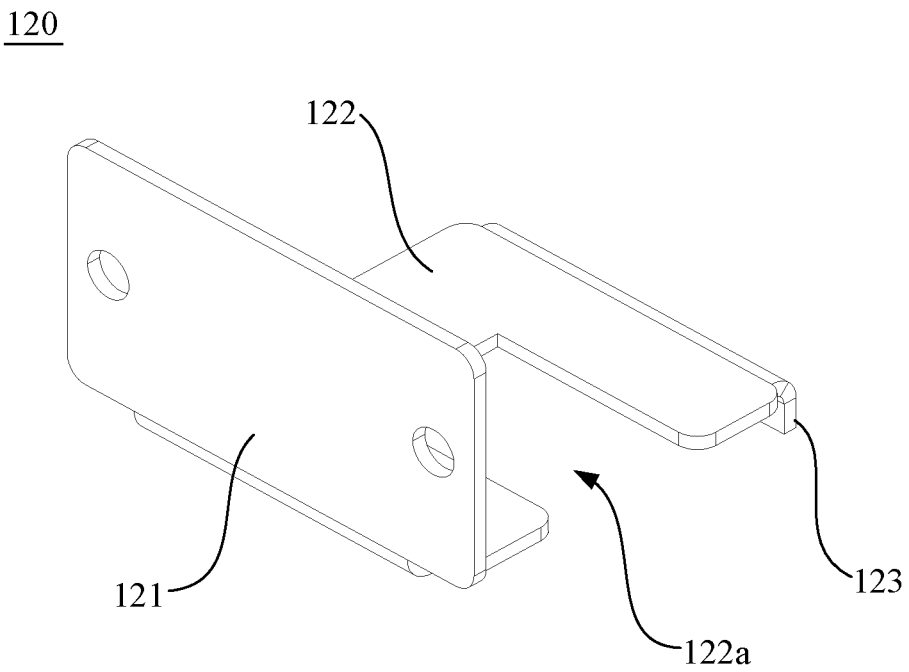
FIG. 15 is a schematic structural diagram of a top cover in a lamp provided by an example of the present disclosure.
Figure 16:
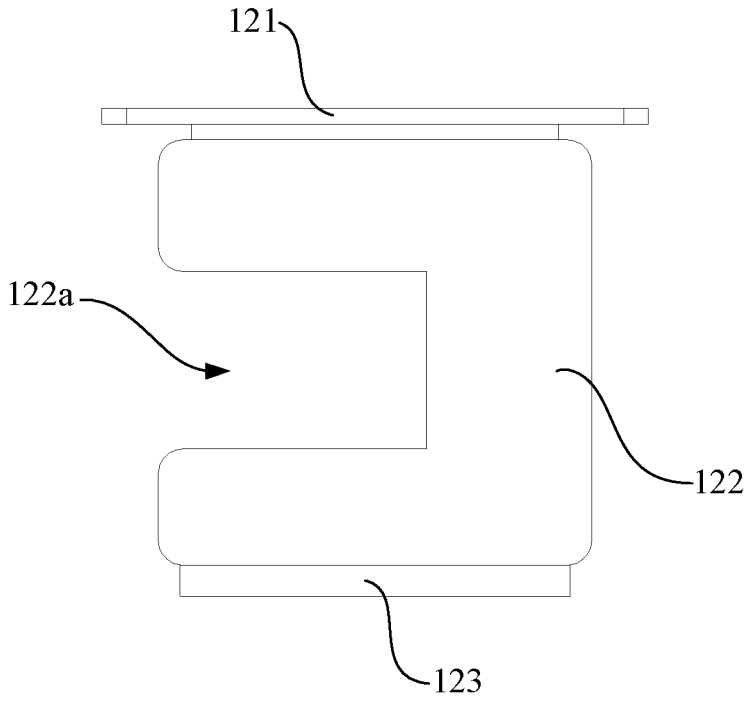
FIG. 16 is a top view of a structure illustrated in FIG. 15.
Figure 17:
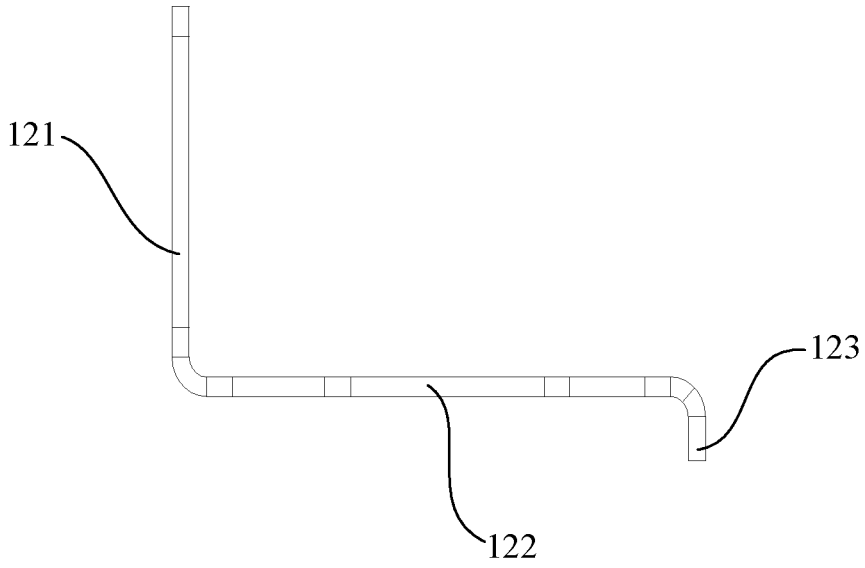
FIG. 17 is a side view of the structure illustrated in FIG. 15.

As illustrated in FIG. 11 and FIG. 12, when the mounting portion 110 is provided in a strip-shaped structure, the mounting portion 110 may have a plurality of mounting holes 112 sequentially arranged in the extending direction of the mounting portion 110. The first electrical terminal 150 is mounted in the mounting hole 112. When the first electrical terminal 150 is mounted, the first electrical terminal 150 passes through the mounting hole 112 with one part trapped within the mounting portion 110 and the other part sticking out relative to the mounting portion 110 to be in plug-in fit with the second electrical terminal 223. With such a solution, the structure of the mounting portion 110 is simplified, so that the first electrical terminal 150 can be mounted on the mounting portion 110 more simply and rapidly.

In an alternative example, for the convenience of allowing the first electrical terminal 150 to be mounted on the mounting portion 110, the first electrical terminal 150 may include a main body 151 and a clamping portion 152 provided on the main body 151. The main body 151 is in plug-in fit with the second electrical terminal 223, and the clamping portion 152 is clamped at the mounting hole 112. The main body 151 is approximately column-shaped. The clamping portion 152 may be structured as a clamped claw, which may undergo deformation when being acted upon by a force. When the first electrical terminal 150 is mounted, an acting force may be applied to the main body 151, causing the clamping portion 152 to stick into the mounting hole 112. In this case, the clamping portion 152 is deformed after being restricted by the wall of the mounting hole 112. When the clamping portion 152 passes through the mounting hole 112, the restriction of the wall of the mounting hole 112 on the clamping portion 152 is lifted, allowing the clamping portion 152 to recover deformation and thus come into contact with one side, far away from the base 210, of the mounting portion 110. Thus, the first electrical terminal 150 cannot be disengaged from the mounting hole 112.

To further improve the waterproofness of the lamp, the lighting assembly 200 or the mounting base 100 may further include a terminal sealing component. The terminal sealing component may be a sealing ring having an O-shaped cross section, a square cross section, or a cross section in any other suitable shape. When the second electrical terminal 223 is positioned around the first electrical terminal 150, the terminal sealing component, as a part of the light-emitting device 220, is hermetically disposed between the second electrical terminal 223 and the base 210 (in particular, the base body 211). When the first electrical terminal 150 is positioned around the second electrical terminal 223, the terminal sealing component 161, as a part of the mounting base 100, is hermetically disposed between the first electrical terminal 150 and the base 210 (in particular, the base body 211).

Alternatively, a second sealing component accommodation groove is provided at the periphery of the second electrical terminal 223 or the periphery of the first electrical terminal 150, and the terminal sealing component is located in the second sealing component accommodation groove, thereby facilitating mounting of the terminal sealing component. In this example of the present disclosure, the first electrical terminal 150 is positioned around the second electrical terminal 223, and the second sealing component accommodation groove 153 is provided at the periphery of the first electrical terminal 150. The terminal sealing component 161 is located in the second sealing component accommodation groove 153 to be hermetically provided between the first electrical terminal 150 and the base 210.

In a further example, as illustrated in FIG. 7, in addition to the base body 211 as described above, the base 210 may further include an annular protrusion 219. The annular protrusion 219 sticks out relative to the base body 211, and the base body 211 surrounds the annular protrusion 219. A terminal accommodation hole 219*a* is provided in the annular protrusion 219, and the second electrical terminal 223 and the first electrical terminal 150 are both located in the terminal accommodation hole 219*a*. The terminal sealing component as described above is hermetically disposed between the second electrical terminal 223 and the wall of the terminal accommodation hole 219*a* or between the first electrical terminal 150 and the wall of the terminal accommodation hole 219*a*. Since the annular protrusion 219 sticks out relative to the base body 211, the terminal accommodation hole 219*a* has a large size in the axial direction thereof with increased area of the wall thereof, so that a larger sealing area can be formed between the terminal sealing component and the wall of the terminal accommodation hole 219*a*, thereby optimizing the water-proof performance of the lamp.

As illustrated in FIG. 11, in this example of the present disclosure, to further improve the water-proof performance of the lamp, the mounting base 100 may further include a mounting portion sealing component 162, and the mounting portion sealing component 162 is hermetically disposed between the mounting portion 110 and the first electrical terminal 150. The mounting portion sealing component 162 may be a sealing ring having an O-shaped cross section, a square cross section, or the like.

In addition to the main body 151 as described above, the first electrical terminal 150 may further include the annular flange 154 provided on the main body 151. The mounting portion sealing component 162 is hermetically disposed between the annular flange 154 and the mounting portion 110. In this case, the annular flange 154 is disposed opposite to the surface, facing the base 210, of the mounting portion 110. After the lighting assembly 200 is mounted on the mounting base 100, the mounting portion sealing component 162 is clamped by the annular flange 154 and the mounting portion 110, and the annular flange 154 and the mounting portion 110 apply a high positive pressure on the mounting portion sealing component 162, resulting in higher sealing performance between the first electrical terminal 150 and the mounting portion 110.

In addition to the mounting portion 110 as described above, the mounting base 100 may further include a top cover 120, and the top cover 120 is disposed at an end of the mounting portion 110. The mounting portion 110 may have a hollow structure, thus achieving lightweight lamp design. The top cover 120 may seal at least a part of the end of the mounting portion 110, so that the inner space of the mounting portion 110 is exposed as little as possible, thus guaranteeing the appearance quality of the lamp.

As illustrated in FIG. 8 to FIG. 17, in an alternative example, the top cover 120 may include a top plate 121 and a bottom plate 122. The top plate 121 and the bottom plate 122 are connected to form an L-shaped structure. The top plate 121 is fixed to the mounting portion 110. Specifically, the top plate 121 may be fixedly connected to the mounting portion 110 by means of a first fastening component 171. The mounting portion 110 has a limiting groove 113. The bottom plate 122 may extend into the limiting groove 113 and be in limiting fit with the limiting groove 113, so that the movement of top cover 120 in the axial direction of the mounting hole 112 of the mounting portion 110 is restricted. With such a structure, the top cover 120 may be inserted in the mounting portion 110 from the top end of the mounting portion 110, and thus the mounting manipulation of the top cover 120 is simplified.

The sidewall of the mounting portion 110 is designed with a thickness, so that the top cover 120 can be fixed to the sidewall of the mounting portion 110. However, this method may lead to a large sidewall thickness of the mounting portion 110, which may be adverse to lightweight lamp design. In view of this, the mounting portion 110 may be provided with a top cover mounting portion 114 inside. The top cover mounting portion 114 is provided with a fastening hole 114*a*, and the first fastening component 171 for fixing the top plate 121 is in fastening fit with the fastening hole 114*a*. The fastening hole 114*a* may be a threaded hole, and the first fastening component 171 is screwed in the fastening hole 114*a*, so that the first fastening component 171 and the fastening hole 114*a* are in screw-thread fit with each other. The fastening hole 114*a* may also be an unthreaded hole, and thread is tapped during the process of screwing the first fastening component 171 in the fastening hole 114*a*, thus realizing screw-thread fit between the first fastening component 171 and the fastening hole 114*a*. In addition, the fastening hole 114*a* may have a notch, so as to facilitate machining of the fastening hole 114*a*. Further, top cover mounting portions 114 may be disposed on two opposite sides of the mounting portion 110, so as to allow the top cover 120 to be more securely fixed.

In this example of the present disclosure, in order to drive the lamp to emit light, the connecting wire for electrical connection is required. The connecting wire for electrical connection may specifically include an inlet wire 181 and an outlet wire 182. To limit the position of the connecting wire for electrical connection, the bottom plate 122 may be provided with a notch 122*a*, and the notch 122*a* allows the connecting wire for electrical connection to pass through. Specifically, there may be two top covers 120 that are mounted at two ends of the mounting portion 110, respectively. Thus, the inlet wire 181 may go through the notch 122*a* of one top cover 120, while the outlet wire 182 may go through the notch 122*a* of the other top cover 120. Under the restriction of the notch 122*a*, the inlet wire 181 and the outlet wire 182 are not prone to changing in position when being acted upon by a pulling force, thus preventing the inlet wire 181 and the outlet wire 182 from being pulled.

The bottom plate 122 of the top cover 120 may have a flat-plate structure with one end connected to the top plate 121 and the other end serving as a free end. In another example, the top cover 120 further includes a bending plate 123. The bending plate 123 and the top plate 121 are connected to two opposite sides of the bottom plate 122, respectively. The bending plate 123 is bent towards the direction away from the light-emitting device 220 and is in sliding fit with the inner wall of the mounting portion 110. When the top cover 120 is inserted in the mounting portion 110, the bending plate 123 is slid relative to the mounting portion 110, thus guiding the movement of the top cover 120 and facilitating the mounting of the top cover 120.

As illustrated in FIG. 11 and FIG. 12, it should be noted that the mounting base 100 further includes a circuit board 190. The connecting wire for electrical connection as described above is electrically connected to the circuit board 190. The circuit board 190 is electrically connected to the light-emitting device 220 (in particular, electrically connected to the second electrical terminal 223 through the first electrical terminal 150). The mounting base 100 further includes a bottom cover 130, and the bottom cover 130 is fixed to the mounting portion 110 to form an accommodation cavity. The circuit board 190 is embedded in the accommodation cavity. Since the circuit board 190 is encapsulated in the mounting portion 110 through embedment, on the one hand, the circuit board 190 can be enveloped reliably and protected against impurities such as liquid, thus allowing the circuit board 190 to operate reliably, and on the other hand, the mounting of the circuit board 190 can be simplified.

In a further example, the bottom cover 130 may include a cover body 131 and a matching protrusion 132 provided on the cover body 131. The cover body 131 may have a flat-plate structure. The matching protrusion 132 may be structured in the form of a plurality of discrete blocks, and extend in a direction consistent with the extending direction of the mounting portion 110. A matching groove is formed between the edge of the cover body 131 and the matching protrusion 132. The mounting portion 110 is provided with a matching protrusion 115 inside, and the matching protrusion 115 is in snap fit with the matching groove. The connection between the bottom cover 130 and the mounting portion 110 can be achieved by means of snap-fit connection between the matching protrusion 115 and the matching groove, so that the manipulation is simple, and the connected structure has high reliability.

To simplify the manufacturing procedure of the bottom cover 130, the matching protrusion 132 may be provided in a strip-shaped structure and extend in a direction parallel to the extending direction of the mounting portion 110. As such, the matching protrusion 132 may have an integrated structure and thus can be manufactured more conveniently, and the integrated matching protrusion 132 better ensure that a plurality of positions of the matching protrusion 132 are at the same height, thus allowing the bottom cover 130 to be in exact fit with the matching protrusion 132 in different positions, so as to improve the fixed strength of the bottom cover 130 and the matching protrusion 132.

During embedment, it is required to fill the mounting portion 110 with glue. For the convenience of controlling the amount of glue filled by the operator, the mounting portion 110 may be provided with a glue identification portion 116 inside. The glue identification portion 116 may specifically have a strip-shaped protruding structure. When the glue filled reaches the glue identification portion 116, it indicates that the amount of the glue filled basically meet the requirement. In this case, the operator may determine whether glue filling is continued according to the actual situation.

Figure 2:
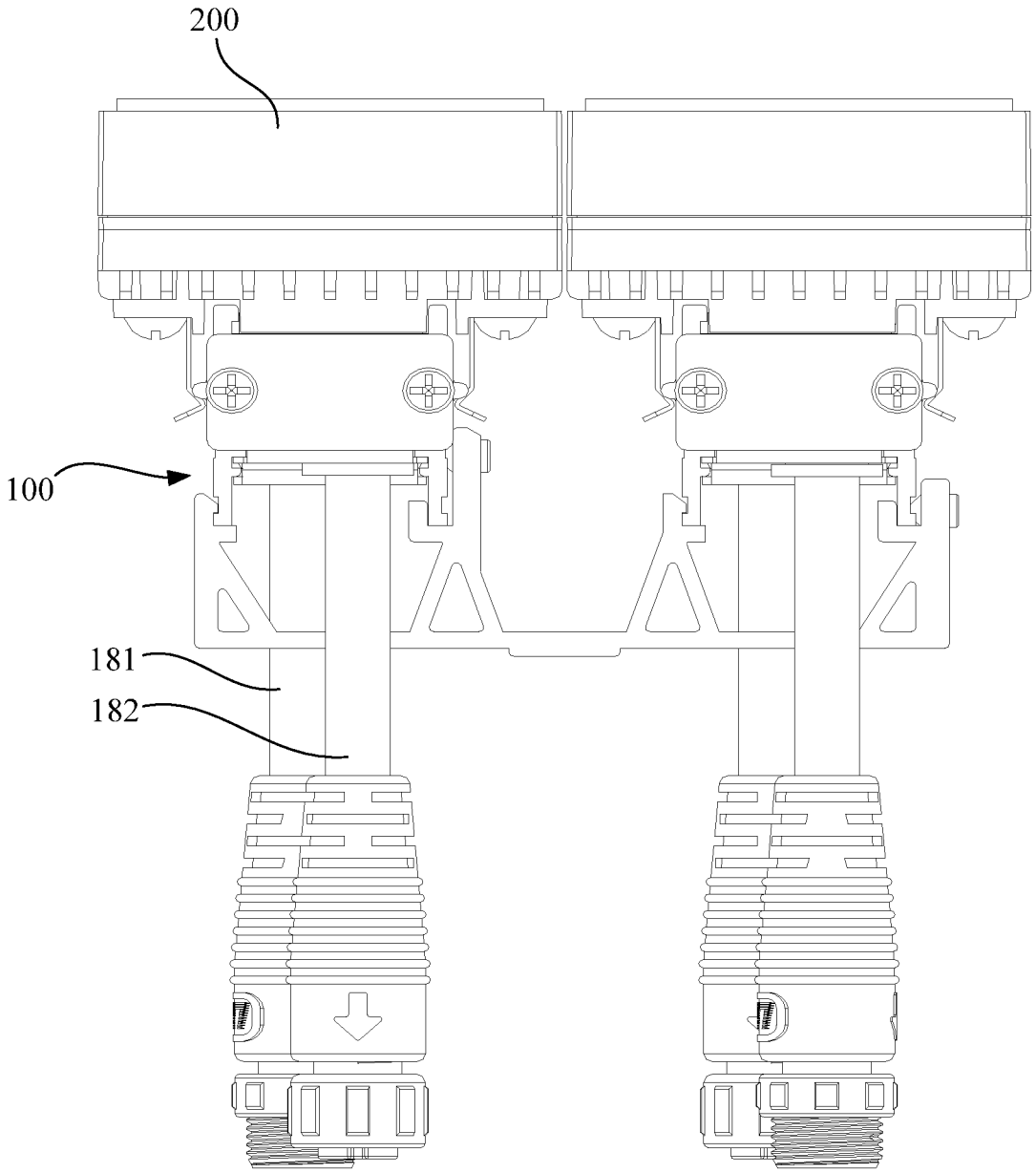
FIG. 2 is a front view of a structure illustrated in FIG. 1.
Figure 3:
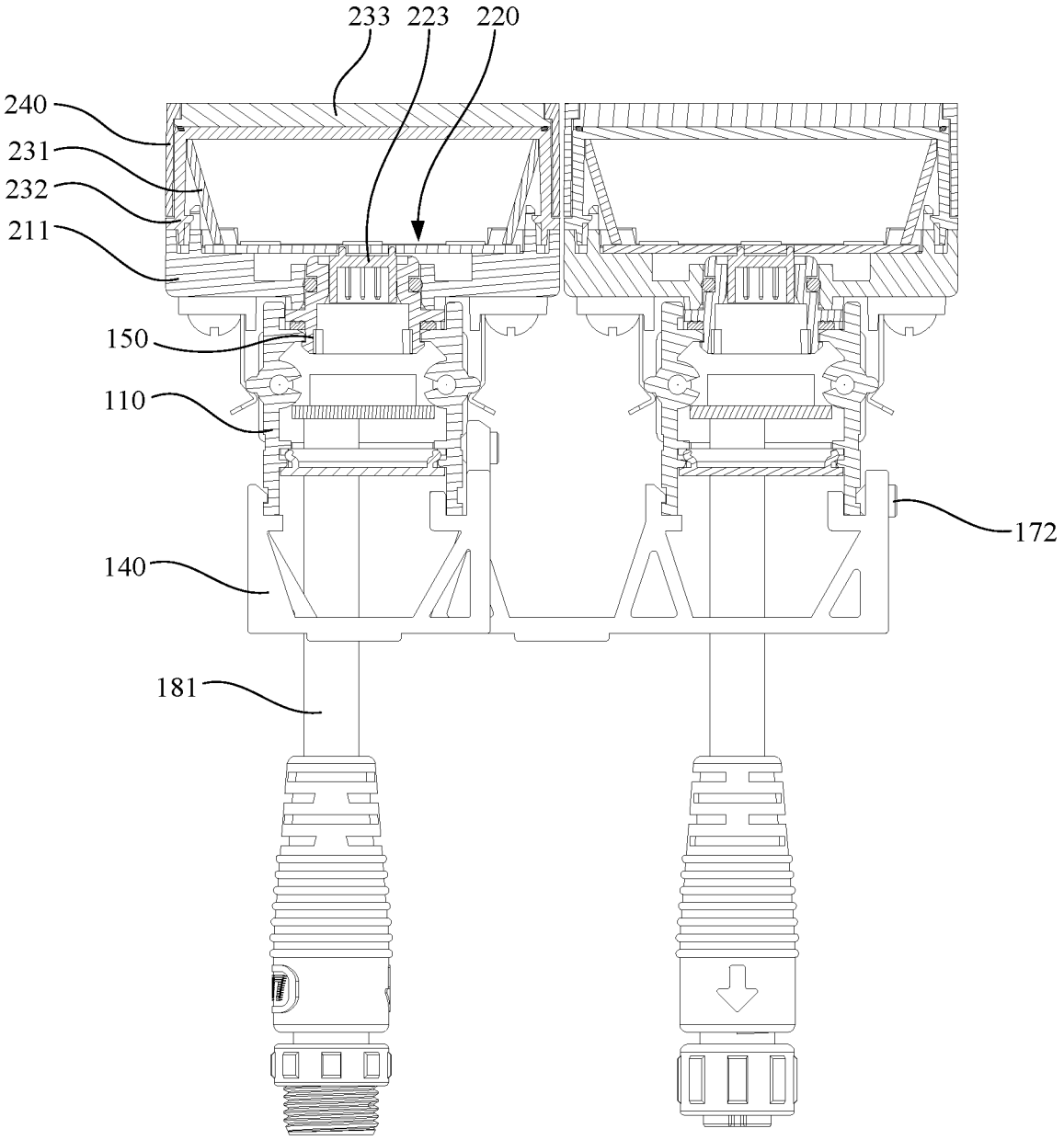
FIG. 3 is a cross-sectional view of a structure illustrated in FIG. 2.

To satisfy higher demand on lighting, there may be a plurality of mounting portions 110 that are arranged side by side, so that a plurality of rows of lighting assemblies 200 can be provided. This involves connection between different mounting portions 110. For this, as illustrated in FIG. 1 to FIG. 3, in the lamp provided by the example of the present disclosure, the mounting base 100 further includes a mounting bracket 140, and the mounting bracket 140 connects at least two mounting portions 110. As such, the mounting portions 110 connected to the same mounting bracket 140 can be retained at the identical height, thereby further improving the appearance and the luminous effect of the lamp.

To guarantee the appearance and the luminous effect of the lamp more reliably, the mounting portions 110 may be arranged at an equal distance from each other.

Figure 21:
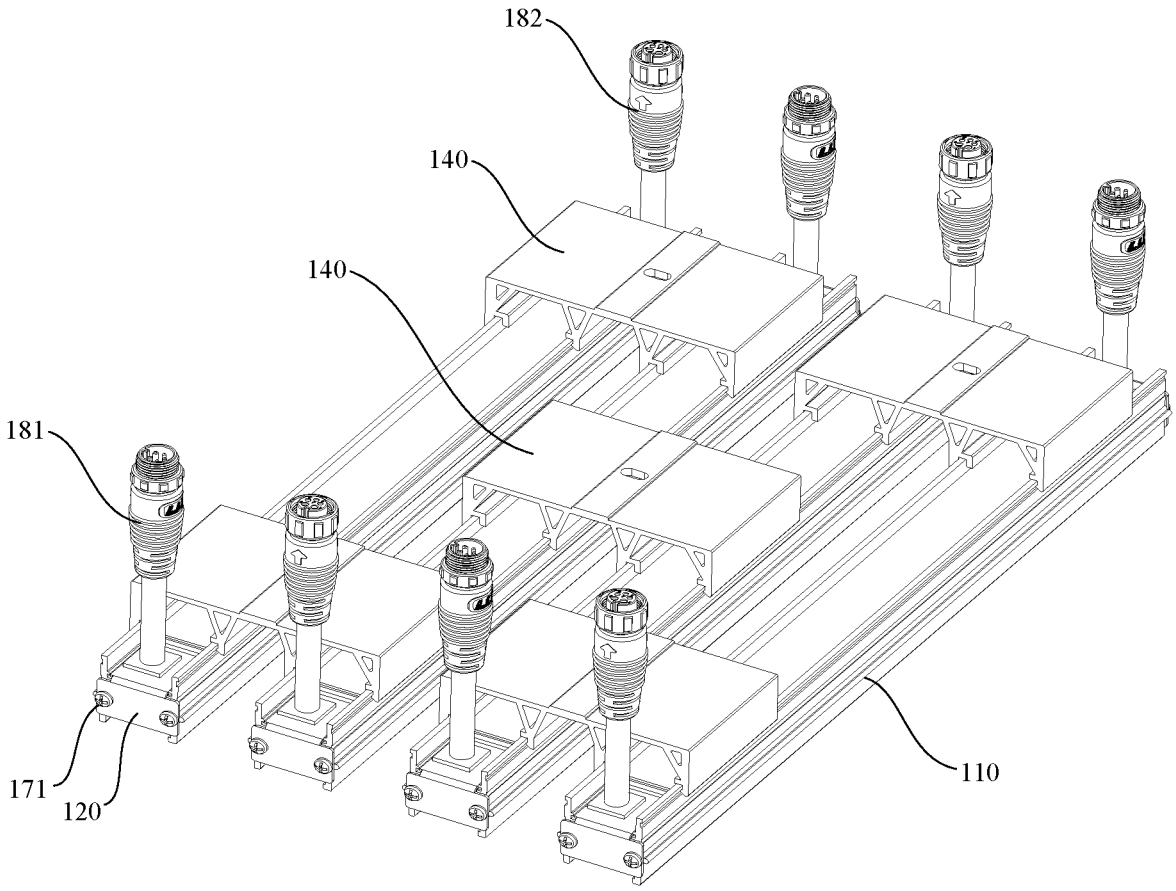
FIG. 21 is a schematic structural diagram of another lamp provided by an example of the present disclosure.

In a specific example, the mounting portions 110 may be connected by the mounting brackets 140 in pairs to form a plurality of sets of mounting portions 110. In this case, since each set of mounting portions 110 has no connection relationship with another set, a difference in height may be caused, which would be adverse to guarantee the appearance and the luminous effect of the lamp. In view of this problem, as illustrated in FIG. 21, every two adjacent mounting portions 110 may be connected by the mounting bracket 140. That is, all the mounting portions 110 are connected by the mounting brackets 140, so that the mounting portions 110 can be all retained at the identical height and can be at uniform intervals, thereby solving the foregoing problem.

Figure 18:
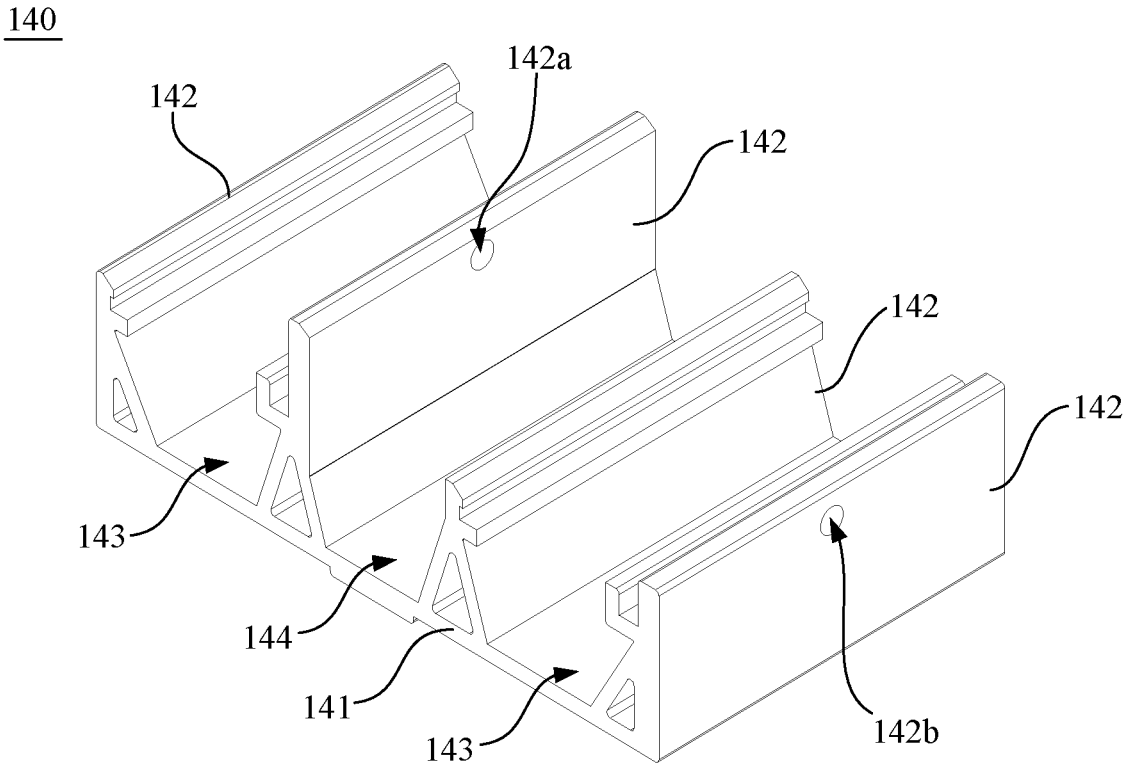
FIG. 18 is a schematic structural diagram of a mounting bracket in a lamp provided by an example of the present disclosure.
Figure 19:
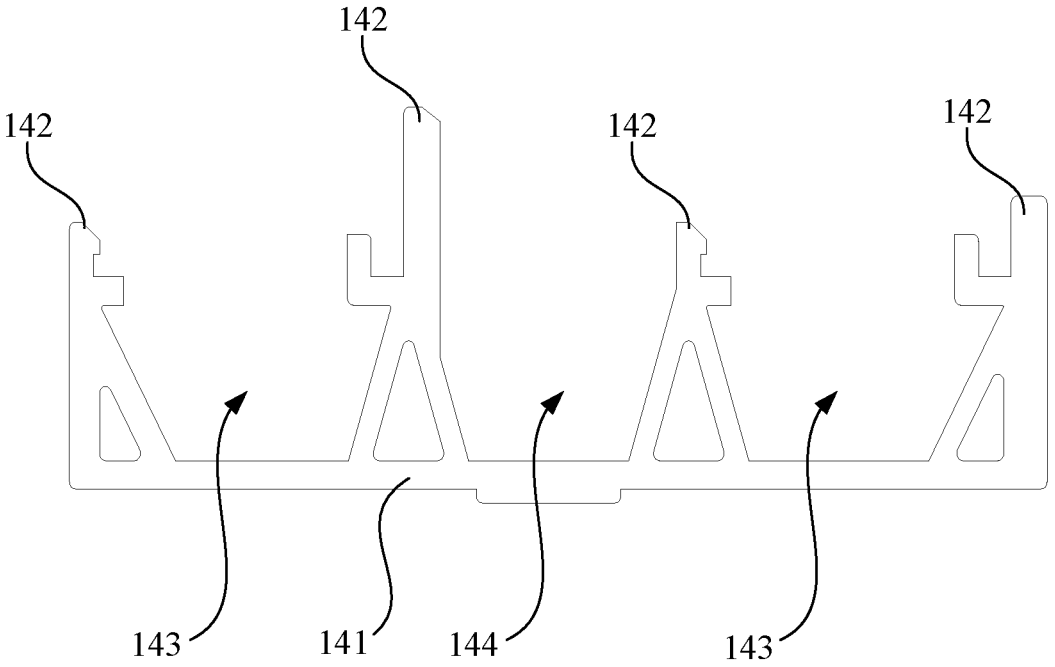
FIG. 19 is a front view of a structure illustrated in FIG. 18.
Figure 20:
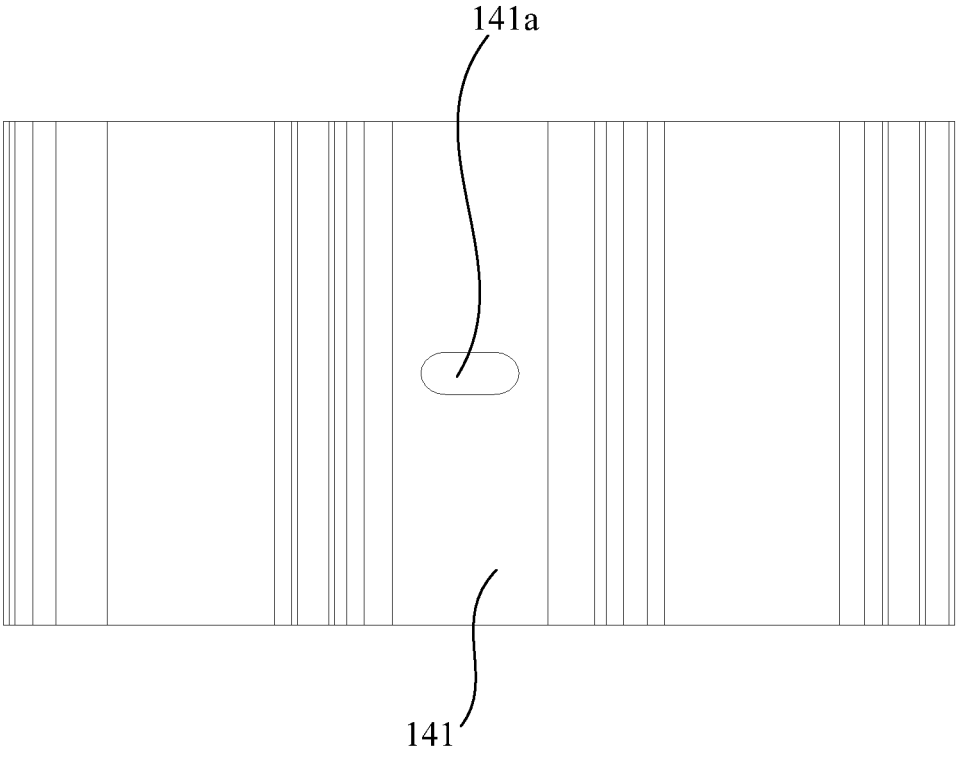
FIG. 20 is a top view of the structure illustrated in FIG. 18.

As illustrated in FIG. 18 to FIG. 20, the mounting bracket 140 may include a main body plate 141, and a plurality of mounting plates 142 which are sequentially mounted on the same side of the main body plate 141. A mounting groove 143 is formed between a part of the adjacent mounting plates 142, while a separation groove 144 is formed between a part of the adjacent mounting plates 142, and the mounting groove 143 and the separation groove 144 are arranged alternately. The mounting portion 110 is connected in the mounting groove 143. Adjacent mounting grooves 143 are spaced apart by the separation groove 144. This method may leave space for related mounting manipulation, and may further leave space for arrangement of the lighting assemblies 200.

At least a part of the plurality of mounting plates 142 are in snap fit with the mounting portion 110, so that the mounting portion 110 and the mounting bracket 140 are assembled together. In addition, at least a part of the mounting plates 142 may be fixed to the mounting portion 110 through second fastening components 172, thereby facilitating assembling and guaranteeing the assembly reliability. Specifically, a part of the mounting plates 142 may be in snap fit with the mounting portion 110, while the rest may be fixed to the mounting portion 110 through the second fastening components 172. Alternatively, a part of the mounting plates 142 may be in snap fit with the mounting portion 110 and also fixed to the mounting portion 110 through the second fastening components 172. To improve the mounting strength and facilitating manipulation, in this example of the present disclosure, the mounting plates 142 clamped with the same side of each mounting portion 110 are preferably fixed to the mounting portion 110 by means of the second fastening components 172, while the other mounting plates 142 are clamped with the mounting portion 110.

Based on the above examples, one of mounting plates located on the same side of the adjacent mounting grooves 143 is provided with a first bracket mounting hole **142*a*, while the other of the mounting plates located on the same side of the adjacent mounting grooves 143 is provided with a second bracket mounting hole 142*b*, and a distance between the first bracket mounting hole 142*a* and the main body plate 141 is greater than a distance between the second bracket mounting hole 142*b* and the main body plate 141. That is, there is a difference in height between the first bracket mounting hole 142*a* and the second bracket mounting hole 142*b*, thus preventing interference when the mounting portion 110** is mounted by the operator.

It should be noted that the above-mentioned "mounting plates located on the same side of the adjacent mounting grooves 143" refer to, among all the mounting plates 142 that form the adjacent mounting grooves 143, the mounting plates located on the same side of the mounting groove 143. Taking four mounting plates 142 as illustrated in FIG. 19 as an example, the four mounting plates 142 are sequentially to be the first mounting plate, the second mounting plate, the third mounting plate, and the fourth mounting plate, the mounting grooves 143 are formed between the first mounting plate and the second mounting plate and between the third mounting plate and the fourth mounting plate, and the separation groove 144 is formed between the second mounting plate and the third mounting plate. In this case, the second mounting plate and the fourth mounting plate are regarded as the "mounting plates located on the same side of the adjacent mounting grooves 143" as described above.

For facilitating wiring, a wire passing hole 141*a* is provided at a position, corresponding to a bottom of the separation groove 144, on the main body plate 141. That is, the wire passing hole 141*a* is communicated with the separation groove 144.

The above examples of the present disclosure focus on the differences between the various examples. As long as the different optimized features between the various examples are not contradictory, they can be combined to form better examples. Considering the simplicity of the text, no more repeated descriptions are provided here.

The above contents are only the examples of the present disclosure, but not intended to limit the present disclosure. Those skilled in the art can make various changes and modifications to the present disclosure. Any modifications, equivalent replacements, improvements and the like that are made without departing from the spirit and the principle of the present disclosure shall all fall within the scope of claims of the present disclosure.

What is claimed is:

1. A lamp, comprising: a mounting base and a lighting assembly, wherein a plurality of lighting assemblies are provided, each of the plurality of lighting assemblies is configured to be detachably mounted on the mounting base, the mounting base comprises a mounting portion, and a plurality of first electrical terminals and a top cover fixed on the mounting portion, the mounting portion is provided in a strip-shaped structure, and the top cover is disposed at top of the mounting portion;

the lighting assembly comprises a base, a light-emitting device, and an optical device, the light-emitting device and the optical device are both mounted on the base, and the base is mounted on the mounting base; and the light-emitting device comprises a second electrical terminal, and the plurality of first electrical terminals are in plug-in fit with a plurality of second electrical terminals of the lighting assemblies in one-to-one correspondence, so as to supply power to the lighting assemblies;

wherein the top cover comprises a top plate and a bottom plate, the top plate and the bottom plate are connected to form an L-shaped structure, the top plate is fixed to the mounting portion, the mounting portion is provided with a limiting groove, and the bottom plate extends into the limiting groove and is in limiting fit with the limiting groove.

2. The lamp according to claim 1, wherein a top cover mounting portion is disposed inside the mounting portion, the top cover mounting portion is provided with a fastening hole, and a first fastening component for fixing the top plate is in fastening fit with the fastening hole;

the bottom plate is provided with a notch, and the notch is configured to allow a connecting wire for power supply to pass through; and the top cover further comprises a bending plate, the bending plate and the top plate are connected to two opposite sides of the bottom plate, respectively, and the bending plate is bent in a direction away from the light-emitting device and in sliding fit with an inner wall of the mounting portion.

3. The lamp according to claim 1, wherein the mounting base further comprises a circuit board, the circuit board is electrically connected to the light-emitting device, the mounting base further comprises a bottom cover, the bottom cover is fixed to the mounting portion to form an accommodation cavity, and the circuit board is embedded in the accommodation cavity;

the bottom cover comprises a cover body and a matching protrusion disposed on the cover body, a matching groove is formed between the cover body and the matching protrusion, a matching protrusion is provided inside the mounting portion, and the matching protrusion is in snap fit with the matching groove;

the matching protrusion is in a strip-shaped structure, and an extending direction of the matching protrusion is parallel to an extending direction of the mounting portion;

a glue identification portion is provided inside the mounting portion; and the light-emitting device further comprises a light source plate and a plurality of light-emitting units disposed on the light source plate, and the second electrical terminal is mounted on the light source plate and electrically connected to the plurality of light-emitting units.

4. A lamp, comprising: a mounting base and a lighting assembly, wherein a plurality of lighting assemblies are provided, each of the plurality of lighting assemblies is configured to be detachably mounted on the mounting base, the mounting base comprises a mounting portion, and a plurality of first electrical terminals and a top cover fixed on the mounting portion, the mounting portion is provided in a strip-shaped structure, and the top cover is disposed at top of the mounting portion;

the lighting assembly comprises a base, a light-emitting device, and an optical device, the light-emitting device and the optical device are both mounted on the base, and the base is mounted on the mounting base; and the light-emitting device comprises a second electrical terminal, and the plurality of first electrical terminals are in plug-in fit with a plurality of second electrical terminals of the lighting assemblies in one-to-one correspondence, so as to supply power to the lighting assemblies;

wherein snap-fit protrusions are provided on two opposite outer sides of the mounting portion, and the lighting assembly is in snap fit with the snap-fit protrusions;

the base comprises a base body, and a first elastic sheet and a second elastic sheet mounted on the base body, the light-emitting device and the optical device are both mounted on the base body, and the first elastic sheet and the second elastic sheet are arranged opposite to each other and in snap fit to the snap-fit protrusions on the two opposite outer sides of the mounting portion, respectively;

each of the first elastic sheet and the second elastic sheet comprises a connecting portion and a snap-fit portion, the snap-fit portion is connected to the base body through the connecting portion, the snap-fit portion is in snap fit with the snap-fit protrusion, the snap-fit portion of the first elastic sheet and the snap-fit portion of the second elastic sheet are bent towards each other;

the snap-fit protrusion is in a strip-shaped structure, first elastic sheets and second elastic sheets of the plurality of lighting assemblies mounted on the mounting portion are all in snap fit with an identical snap-fit protrusion;

the connecting portion comprises a first connecting plate and a second connecting plate, the first connecting plate and the second connecting plate are connected to form an L-shaped structure, the first connecting plate fits and is in fixed connection to the base body, and the second connecting plate is connected to the snap-fit portion; and in a single lighting assembly, a plurality of first elastic sheets and/or a plurality of second elastic sheets are arranged in an extending direction of the mounting portion.

5. A lamp, comprising: a mounting base and a lighting assembly, wherein a plurality of lighting assemblies are provided, each of the plurality of lighting assemblies is configured to be detachably mounted on the mounting base, the mounting base comprises a mounting portion, and a plurality of first electrical terminals and a top cover fixed on the mounting portion, the mounting portion is provided in a strip-shaped structure, and the top cover is disposed at top of the mounting portion;

the lighting assembly comprises a base, a light-emitting device, and an optical device, the light-emitting device and the optical device are both mounted on the base, and the base is mounted on the mounting base; and the light-emitting device comprises a second electrical terminal, and the plurality of first electrical terminals are in plug-in fit with a plurality of second electrical terminals of the lighting assemblies in one-to-one correspondence, so as to supply power to the lighting assemblies;

wherein the lighting assembly further comprises a surface cover, the optical device comprises a reflector and a diffusion casing covering the reflector, the reflector is disposed on a light-emitting side of the light-emitting device, the diffusion casing is in fixed connection to the base and has a top arranged opposite to the light-emitting device, and the surface cover is fastened outside the diffusion casing;

the base is provided with a first snap-fit protrusion protruding towards the diffusion casing, an inner surface of the diffusion casing is provided with a second snap-fit protrusion, and the first snap-fit protrusion is in snap fit with the second snap-fit protrusion;

a third snap-fit protrusion is provided on one of a group consisting of an outer surface of the diffusion casing and an inner surface of the surface cover, a snap-fit depression is provided on another of the group consisting of the outer surface of the diffusion casing and the inner surface of the surface cover, and the third snap-fit protrusion is in snap fit with the snap-fit depression;

the outer surface of the diffusion casing comprises a plurality of lateral surfaces sequentially connected to each other, and a plurality of snap-fit depressions are disposed on a part of the lateral surfaces; and the base is provided with an annular locating groove, a bottom edge of the diffusion casing is located in the annular locating groove, a locating flange is provided on an outer surface of the diffusion casing, and the locating flange is in locating fit with a top edge of the base.

* * * * *